US008167050B2

(12) United States Patent
Webre et al.

(10) Patent No.: US 8,167,050 B2
(45) Date of Patent: May 1, 2012

(54) METHOD AND APPARATUS FOR MAKING UP AND BREAKING OUT THREADED TUBULAR CONNECTIONS

(75) Inventors: Charles Michael Webre, Lafayette, LA (US); Brennan Scott Domec, Lafayette, LA (US); Vernon J. Bouligny, New Iberia, LA (US)

(73) Assignee: Frank's casing Crew & Rental Tools, Inc., Lafayette, LA (US)

( * ) Notice: Subject to any disclaimer, the term of this patent is extended or adjusted under 35 U.S.C. 154(b) by 427 days.

(21) Appl. No.: 12/496,205

(22) Filed: Jul. 1, 2009

(65) Prior Publication Data

US 2011/0000682 A1 Jan. 6, 2011

Related U.S. Application Data

(60) Provisional application No. 61/077,210, filed on Jul. 1, 2008.

(51) Int. Cl.
*E21B 19/16* (2006.01)

(52) U.S. Cl. ..... 166/380; 166/77.1; 166/77.51; 166/77.52; 166/85.1; 294/86.24; 294/86.25

(58) Field of Classification Search ..... 166/380, 166/77.1, 77.52, 77.53, 85.1, 77.51; 294/86.24, 294/86.25

See application file for complete search history.

(56) References Cited

U.S. PATENT DOCUMENTS

| | | | | | |
|---|---|---|---|---|---|
| 1,508,417 | A | * | 9/1924 | Spitler | 294/86.21 |
| 1,777,592 | A | * | 10/1930 | Thomas | 294/86.17 |
| 1,825,026 | A | * | 9/1931 | Thomas | 294/86.19 |
| 4,576,254 | A | | 3/1986 | Cox | |
| 4,762,187 | A | | 8/1988 | Haney | |
| 4,986,146 | A | | 1/1991 | Buck | |
| 2004/0216924 | A1 | | 11/2004 | Pietras et al. | |

FOREIGN PATENT DOCUMENTS

| | | | |
|---|---|---|---|
| EP | 1568847 | A2 | 8/2005 |
| WO | WO2006116870 | A1 | 11/2006 |

OTHER PUBLICATIONS

PCT/US2009/049405 "International Search Report and Written Opinion" dated Nov. 4, 2009, 13 pages.

* cited by examiner

*Primary Examiner* — Giovanna Wright
(74) *Attorney, Agent, or Firm* — Winstead PC

(57) ABSTRACT

An internally gripping tong to rotate tubular segments comprising a central cam body rotatably disposed within a housing having a plurality of windows. The cam body is surrounded by a plurality of angularly distributed gripping jaws slidably received within the windows. The tong is disposed within a bore of a tubular segment, and rotation of the housing relative to the cam body deploys the gripping jaws radially outwardly within the windows to engage the interior wall of the tubular segment. The tong may be self-energizing in both the make-up and the break-out modes of operation. The tong may be deployed to grip the tubular segment using a device to frictionally couple the housing to the tubular segment that cooperates with the top drive assembly, or by an internal actuator that imparts rotation to the housing relative to the cam body.

19 Claims, 21 Drawing Sheets

METHOD AND APPARATUS FOR MAKING UP AND BREAKING OUT THREADED TUBULAR CONNECTIONS

This application claims the benefit of U.S. provisional patent application No. 61/077,210, filed on 1 Jul. 2008.

BACKGROUND OF THE INVENTION

1. Field of Invention

This invention is directed to a method and a tool that can be used in place of a conventional power tong for making up and for breaking out threaded connections in tubular strings used in drilled wells. Specifically, the present invention is directed to a method and a tool for internally gripping and then rotating a tubular segment to make-up or break-out a threaded connection between the tubular segment and a suspended tubular string.

2. Background of the Related Art

Oil field tubular members, e.g., drill pipe, production tubing and casing strings, are generally produced in tubular segments that are threadedly coupled into a tubular string using threaded connections, such as sleeve-type or integral threaded connections, at their ends. Power tongs are machines that may be used to make-up and break-out threaded connections between adjacent tubular segments by gripping a first tubular segment, and by gripping and rotating an adjacent second tubular segment relative to the first tubular segment to either make-up or break-out the threaded connection between the two.

FIG. 1 is a perspective view of a prior art externally gripping power tong 200. The power tong 200 has a drive motor 210 that may be hydraulically or pneumatically-powered, and a gripping assembly mechanically coupled to the motor for gripping and rotating a tubular segment received within the bay 206. A generally "C"-shaped gear housing 212 supports a pair of pivoting doors 214 which may be closed to secure the bay 206 or swung open (as indicated in FIG. 1) to provide access to the bay 206. The bay 206 is generally surrounded by the gear housing 212. The center of the bay 206 is between a pair of generally opposed pivotable gripping jaws 220, each having a generally arcuate gripping surface disposed radially inwardly toward the center of the bay 219.

An externally gripping power tong, like that shown in FIG. 1, is generally supported within a frame or skid that is movably supported on the rig floor so that it can be moved to and withdrawn from well center as needed to make-up or to break-out threaded connections. The frame or skid is generally large and heavy, and takes up a large amount of valuable rig storage space when it is not in use. Also, a conventional power tong, like that shown in FIG. 1, occupies a large amount of space when in use on the rig floor, and the movement of this large piece of equipment to and from well center requires coordination with other equipment and activities on the rig.

Gripping the exterior of the tubular segment being threadably coupled to the tubular string suspended in the well generally avoids interference with or obstruction of fill-up and circulation tools used to intermittently introduce fluid into the bore of the tubular string to maintain fluid levels within the tubular string and to avoid unwanted downhole pressure differentials that may otherwise damage or collapse the tubular string. However, the significant disadvantages of externally gripping power tongs give rise to a need for an alternative device and method for making up and breaking out threaded connections in tubular strings on a rig.

What is needed is a device for gripping and rotating a tubular segment that does not take up a large amount of valuable rig floor space. What is needed is a device for gripping and rotating a tubular segment that does not require movement of rig equipment to well center to grip and rotate tubulars. What is needed is a device for gripping and rotating a tubular segment that facilitates unfettered introduction of fluid into the bore of the tubular string as additional tubular segments are added to the tubular string. What is needed is a device for gripping and rotating a tubular segment that is self-energizing, and that may be adapted for being self-energizing for both making up and breaking out the threaded connection. What is needed is a method of making up and running a tubular string in a borehole that includes the step of supporting an elevator from a top drive assembly using bails, the step of rotatably supporting a self-energizing internally gripping tong from the quill of the top drive generally intermediate the bails, and the step of inserting the internally gripping power tong into the bore of a tubular segment to make-up and torque the threaded connection between the tubular segment and the tubular string.

SUMMARY OF THE PRESENT INVENTION

Embodiments of the invention satisfy some or all of the needs described above. In one embodiment, the invention provides a method of making up and running a tubular string into a borehole using an internally gripping power tong and a top drive assembly. The method includes the steps of supporting an elevator from a top drive assembly using bails, rotatably supporting a self-energizing internally gripping power tong from the quill of the top drive assembly generally intermediate the bails, inserting the internally gripping power tong within the bore of an tubular segment that is generally vertically supported by the proximal end of a tubular string suspended within a borehole using a tubular string suspending device, such as a collar load support device or a spider. The method further includes the steps of deploying the internally gripping power tong within the bore of the tubular segment to grip the tubular segment, rotating the tool and the tubular segment relative to the tubular string to make-up the threaded connection between the tubular segment and the tubular string, retracting the internally gripping power tong to release the tubular segment, and withdrawing the internally gripping power tong from the bore of the tubular segment. Embodiments of the invention provide an internally gripping power tong to releasably internally grip a tubular segment to rotate the tubular segment and threadably coupling the tubular segment to a suspended tubular string to lengthen the tubular string.

In another embodiment, the invention provides a method of making up and running a tubular string in a borehole including the steps of deploying an internally gripping power tong within the bore of a tubular segment by rotating a generally tubular tong housing, and a set of gripping jaws received within windows in the tong housing, relative to a central cam body disposed within the bore of the tong housing to engage, cam and deploy each gripping jaw radially outwardly through its window in the tong housing.

In yet another embodiment, the invention provides a thread compensation assembly for permitting movement of the tubular tong housing, and the gripping jaws movably received within the windows of the tong housing, along an axially splined portion of a shaft to compensate for the axial movement of the tubular segment toward a suspended tubular string as a threaded connection between the tubular segment and the suspended tubular string is made up using the internally gripping power tong of the present invention. In a reverse action, the thread compensation assembly permits movement of the tong housing and the gripping jaws along an axially splined portion of a shaft to compensate for the axial movement of the tubular segment away from a suspended tubular string as the threaded connection between the tubular segment and the suspended tubular string is broken out using the internally gripping power tong.

In yet another embodiment, the internally gripping power tong is adapted for being supported from the rotatable quill of a top drive assembly and generally between a pair of bails that suspend a string elevator from the non-rotating collar ring of the top drive assembly. The bails suspended from the collar ring may be adapted for being powered to pivot about their top ends to position an elevator supported at their bottom ends substantially out vertical alignment with the suspended tubular string in the borehole to engage a tubular segment at or near its first, proximal end. The tubular segment, having the first, proximal end and a second, distal end, may be suspended from the elevator by its first, proximal end, and then lowered to cause the second, distal end of the tubular segment to contact and bear against the upwardly disposed, proximal end of a tubular string suspended in a borehole using a tubular string suspending device, such as a collar load support device or a spider. As the top drive assembly is lowered further toward the suspended tubular string—after the second end of the tubular segment bears against and is supported by the proximal end of the suspended tubular string—the elevator slides downwardly along at least a portion of the length of the tubular segment as the internally gripping power tong is inserted into the aligned bore of the tubular segment at its first end. The internally gripping tool is then deployed within the bore of the tubular segment to grip the interior wall of the tubular segment, and the internally gripping tool is rotated to make-up the connection between the tubular segment and the suspended tubular string.

One embodiment of the internally gripping power tong of the present invention comprises a hollow shaft having an externally splined portion for being coupled to the rotatable quill of the top drive assembly, a central cam body having a plurality of cam surfaces thereon and slidably received onto the shaft, and a plurality of gripping jaws, each movably captured within a window or aperture within a tubular housing that is rotatable relative to the central cam body. The windows of the tubular housing are angularly distributed about axis of the shaft and adjacent to the central cam body, with at least one cam surface positioned adjacent to each gripping jaw for engaging and deploying the gripping jaw radially outwardly through the window in the tubular tong housing in which the gripping jaw is movably received. Rotation of the tong housing relative to the central cam body causes the gripping jaws to be cammed and deployed radially outwardly through the windows, and to engage and grip the interior wall of a tubular segment in which the internally gripping tong is disposed.

Once the gripping jaws are deployed to grip the interior wall of the tubular segment, the top drive assembly may be used to rotate the internally gripping power tong to make-up a threaded connection between the tubular segment and a suspended tubular string. As the threaded connection tightens and the internally gripping power tong encounters increasing resistance to continued rotation, the gripping jaws are further cammed to self-tighten the grip on the tubular segment.

A threaded connection joining a tubular segment to a suspended tubular string may be broken out by reversing the operation of some embodiments of the internally gripping tong of the present invention to rotate the tubular housing relative to the central cam body, but in the opposite direction, to again cam the gripping jaws radially outwardly to engage and grip the interior wall of the tubular segment to be removed and separated from the suspended tubular string. Increased resistance to breaking out the connection only tightens the grip on the tubular segment by further camming the gripping jaws outwardly against the interior wall of the tubular segment.

A "contact-type" actuator may be used to deploy the internally gripping power tong using rotation of the top drive assembly quill that supports the internally gripping power tong. A first "contract-type" actuator comprises external elastomeric sprags supported on the exterior wall of the tubular housing to contact and to frictionally couple the tubular housing to the interior wall of the tubular segment into which the internally gripping power tong is inserted. Rotation of the internally gripping power tong using the top drive assembly quill causes the central cam body to rotate relative to the tubular housing, which resists rotation along with the top drive assembly quill due to the tubular segment being frictionally coupled to the tubular housing by the sprags that extend from the exterior of the tubular housing. In an embodiment of the internally gripping power tong of the present invention having elastomeric sprags, an internally gripping power tong comprises a hollow shaft having an externally-splined portion thereon and having a central cam body slidably received thereon, a plurality of gripping jaws movably received within windows of a tubular housing, the gripping jaws positioned generally adjacent to the central cam body disposed within the bore of the tubular housing for rotation relative to the tubular housing to cam the gripping jaws radially outwardly through the windows to grip the interior wall of a tubular segment. The gripping jaws of this embodiment are actuated by rotation of the shaft and the central cam body slidably received thereon relative to the tubular housing while the tubular housing resists rotation within the bore of the tubular segment due to the friction imparted by the radially outwardly disposed elastomeric sprags secured to the exterior of the tubular housing. The generally angularly distributed elastomeric sprags are axially forced into the annulus between the exterior of the internally gripping power tong and the interior wall of the tubular segment upon insertion of the internally gripping power tong into the bore of the tubular segment. The elastomeric sprags may be strategically shaped to grip the interior wall of the tubular segment upon rotation of the internally gripping power tong in a first direction, and to generally collapse to permit rotation of the internally gripping power tong within the bore of the tubular segment in an opposite, second direction. In another embodiment of the internally gripping power tong of the present invention, a second set of elastomeric sprags may be used, in conjunction with the first set of sprags, to cause the internally gripping power tong to frictionally engage the interior wall of the tubular segment when the internally gripping power tong is rotated by the top drive assembly in either direction.

An alternate embodiment of the internally gripping power tong of the present invention having a "contact type" actuator comprises an outrigger assembly, instead of the elastomeric sprags, for providing contact and frictional engagement between the tong housing of the internally gripping power tong and the interior wall of the tubular segment, and thereby imposing on the tong housing a resistance to rotation within the bore of a tubular segment. The outrigger assembly may be hydraulically, pneumatically, electrically or manually powered to radially deploy outriggers outwardly through windows within the tong housing of the outrigger assembly to engage and grip the interior wall of the tubular segment. Upon rotation of the splined shaft by rotation of the top drive assembly quill, the central cam body rotates with the splined shaft as the tong housing resists rotation due to its engagement, through the outrigger assembly, with the interior wall of the tubular segment into which the internally gripping power tong is received. The differential in torque and resulting rotation between the central cam body and the tong housing causes the gripping jaws to be cammed radially outwardly through the windows or apertures of the tong housing.

In another, preferred embodiment, the internally gripping power tong of the present invention comprises a rotary vaned actuator assembly for imparting rotation to the central cam body relative to the tubular tong housing instead of using a contact-type device such as an arrangement of elastomeric sprags or an outrigger assembly, to engage and grip the interior wall of the tubular segment for actuating the tong. The rotary vaned actuator assembly may be powered to rotate the central cam body relative to the tubular housing by pneumatic or hydraulic pressure.

The central cam body of the internally gripping power tong of the present invention may be adapted such that some embodiments of the internally gripping power tong of the present invention are self-energizing in both the make-up mode of operation and break-out mode of operation. The self-energizing feature may be provided by central cam body symmetry that engages each gripping jaw with one of two adjacent cam surfaces on the central cam body, and the rotation of the tong housing relative to the central cam body determines which of the two adjacent cam surfaces engages and cams the adjacent gripping jaw into engagement with the interior wall of the tubular segment.

The foregoing and other objects, features and advantages of the invention will be apparent from the following more particular description of a preferred embodiment of the invention, as illustrated in the accompanying drawings wherein like reference numbers represent like parts of the invention.

DETAILED DESCRIPTION OF THE PRESENT INVENTION

Figure 1:
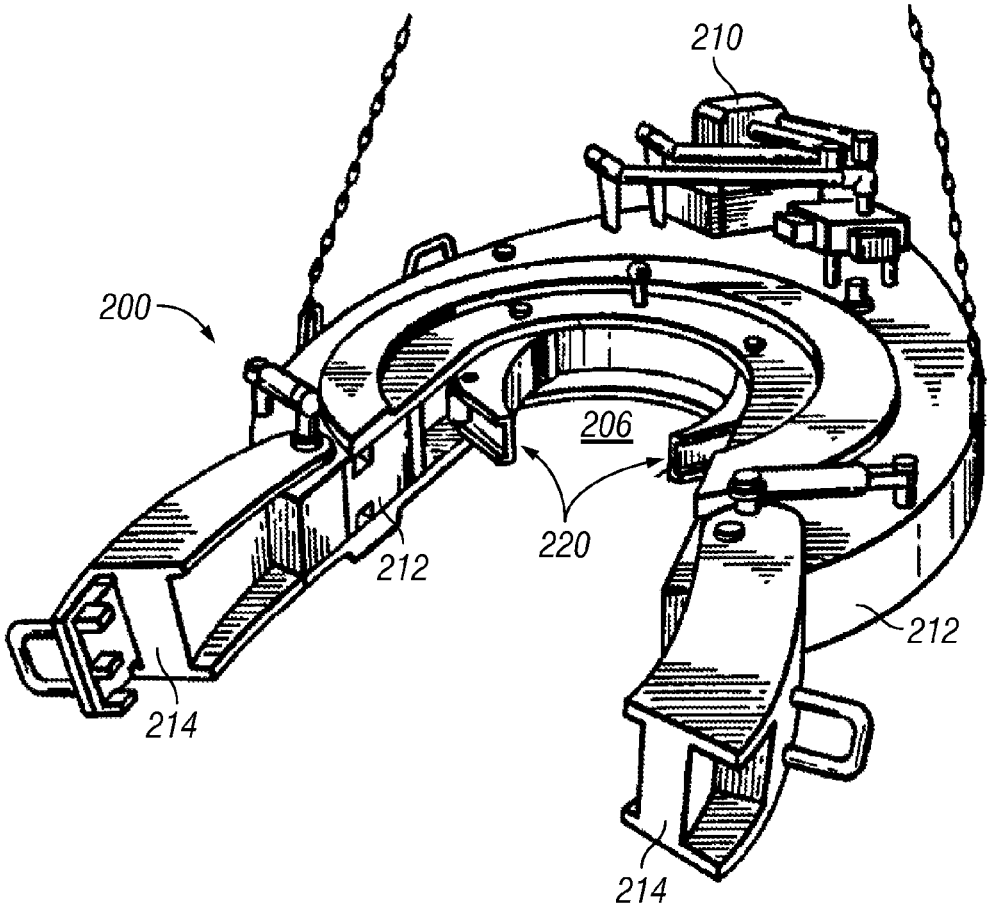
FIG. 1 PRIOR ART
FIG. 1 is a perspective view of a prior art externally gripping power tong for gripping and rotating a tubular segment to make-up or break-out a threaded connection.

The embodiments of the internally gripping power tong illustrated in the appended drawings comprises a central cam body slidably received onto an externally-splined portion of a hollow shaft that is generally centered within the bore of a generally tubular tong housing that is rotatable within a limited range relative to the shaft and the central cam body received thereon. The rotation of the tubular tong housing relative to the central cam body is about an axis that is generally coincident with the axis of the shaft, and also with the axis of the bore of a tubular segment to be gripped and rotated using the internally gripping power tong. The tubular tong housing comprises a plurality of windows or apertures that are generally angularly spaced about and adjacent the central cam body. Each window slidably receives a gripping jaw that is deployable radially outwardly through the window upon rotation of the tubular tong housing, and the windows therein, relative to the central cam body.

In one embodiment, the windows in the tubular tong housing, and the gripping jaws slidably received within the windows, are equi-angularly spaced about the central cam body for even gripping of the interior wall of the tubular segment. The central cam body may comprise a first cam positioned for engaging and slidably deploying a given first gripping jaw radially outwardly through the window in which the first gripping jaw is slidably received, and against the interior wall of the tubular segment, upon rotation of the tubular tong housing relative to the central cam body in a first direction. The central cam body may further comprise a second, adjacent cam of the central cam body for engaging and slidably deploying the first gripping jaw radially outwardly through the window and against the interior wall of the tubular segment upon rotation of the tong housing relative to the central cam body, but in the second, opposite direction. The first and the second cam may be disposed within a common cam trough on the central cam body, and the central cam body may comprise a plurality of such cam troughs, each having a pair of opposed cams, each pair positioned to engage and deploy a gripping jaw positioned adjacent to the cam trough. Between each adjacent cam trough of such a central cam body is a cam lobe. Each cam lobe of the central cam body may also comprise two cams, one positioned to engage a first gripping jaw upon rotation of the tong housing relative to the central cam body in the first direction, and a second cam to engage a second, adjacent gripping jaw upon rotation of the tong housing relative to the central cam body in the opposite direction.

An actuator may be used to impart rotation of the tong housing relative to the splined portion of the hollow shaft and the central cam body received thereon to deploy the gripping jaws into gripping engagement with the interior wall of the tubular segment. In a preferred embodiment, the tong housing may be rotated relative to the central cam body using a rotary vaned actuator assembly comprising a vaned assembly rotatable within and relative to an actuator housing in which the vaned assembly is disposed. The vaned assembly may be rotatably and sealably disposed intermediate two plates that couple to close the actuator housing to define a plurality of variable-sized fluid chambers angularly disposed between the vanes of the vaned assembly, and axially disposed between the plates coupled on either side of the actuator housing. The rotary vaned actuator may be operated by hydraulic or pneumatic pressurization of one or more chambers to impart torque on the tong housing of the actuator relative to the vaned assembly. The actuator housing may be coupled to the tong housing that is disposed about the central cam body, and the vaned assembly is coupled to the central cam body so that rotation of the actuator housing relative to the vaned assembly imparts rotation of the tong housing and the windows (containing the gripping jaws) within the tong housing, all relative to the central cam body. The rotary vaned actuator generates a torque differential between the splined shaft to which the central cam body is rotatably locked and the tubular tong housing, and the relative rotation can be achieved without rotation of the quill of the top drive assembly. This allows for using the internally gripping power tong to grip the tubular segment, and then for subsequent rotation of the quill of the top drive assembly to make-up or break-out the threaded connection between the tubular segment and the suspended tubular string.

In alternate embodiments of the internally gripping power tong of the present invention, a "contact-type" actuator may be used in cooperation with the top drive assembly to actuate the internally gripping power tong to grip the tubular segment. In a first alternate embodiment, the top drive assembly and an arrangement of elastomeric sprags may be used together to impart rotation to the tong housing relative to the central cam body by using the quill top drive assembly to rotate the splined shaft on which the central cam body is slidably received, and by causing the tong housing to resist concurrent rotation with the central cam body using an angularly distributed arrangement of elastomeric sprags, or a "sprag ring." Specifically, the sprag ring prevents rotation of the tong housing with the central cam body and the splined shaft on which the central cam body is received, but in one direction only, and it allows the shaft, central cam body and the tong housing to rotate together within the bore of the tubular segment in the opposite direction. Each sprag generally comprises a resilient and compressible material, and each sprag may be shaped to permit sliding movement of the interior wall of the tubular segment relative to the sprags and the exterior of the tong housing resulting from rotation of the splined shaft and the central cam body in a first direction relative to the tong housing, but to oppose sliding movement of the interior wall of the tubular segment in the opposite direction upon rotation of the splined shaft and the central cam body in a second, opposite direction. When the splined shaft and the central cam body are rotated in this opposite direction, the sprags engage and grip the interior wall of the tubular segment to prevent or to impart resistance to rotation of the housing with the splined shaft and the central cam body. The resulting differential torque between the tong housing and the central cam body causes the gripping jaws to deploy against the interior wall of the tubular segment.

An alternate embodiment of the present invention comprises an outrigger assembly having a plurality of radially deployable outriggers for engaging the interior wall of the tubular segment in which the internally gripping power tong is inserted. The outrigger assembly provides one or more cylinders or other mechanisms for radially deploying one or more of the outriggers. A cylinder used for deployment may be pneumatically or hydraulically powered. The housing of the outrigger assembly is coupled to, and may be integral with, the tong housing so that deployment of the outrigger assembly prevents or resists rotation of the tong housing within the bore of the tubular segment into which the tong is inserted. Like the other "contact-type" actuator that utilizes sprags, the resulting differential torque between the tong housing and the central cam body causes the gripping jaws to deploy against the interior wall of the tubular segment.

With either the rotary vaned actuator, the elastomeric sprag ring or the outrigger assembly, rotation of the shaft of the internally gripping power tong using the supporting top drive assembly quill relative to the tong housing radially deploys the gripping jaws to engage and grip the interior wall of the tubular segment. Continued rotation of the top drive quill rotates the internally gripping power tong and the tubular segment to make-up the threaded connection between the lower end of the tubular segment and the proximal end of the suspended tubular string. As the threaded connection is theadably made-up, the resistance to continued rotation results in a greater torque between the splined shaft and the tong housing, thereby further camming the gripping jaws radially outwardly, and further disposing of the gripping jaws into engagement with the interior wall of the tubular segment. This feature of the tong of the present invention provides a "self-energizing" grip.

One embodiment of the internally gripping tong comprises a hollow splined shaft having an axis of rotation and a plurality of axial splines along its exterior surface for slidably receiving the central cam body. For the preferred embodiment having the rotary vaned actuator assembly, the splined shaft slidably receives the central cam body and the vaned assembly to rotatably lock one to the other. Both the central cam body and the vaned assembly may have comprise bores with mating splines for being slidably received onto the externally-splined shaft. The vaned assembly is slidably received onto a portion of the hollow shaft in a spaced-apart relationship to the central cam body so that the central cam body and the vaned assembly are rotatably locked one to the other, but slidable along the shaft to facilitate thread make-up or breakout by powered rotation of the splined shaft. This embodiment of the internally gripping power tong further comprises a tubular tong housing comprising a plurality of windows, each for slidably receiving a gripping jaw. The tong housing receives at least a portion of the hollow, splined shaft and the central cam body within its bore to position the gripping jaws generally adjacent to the central cam body so that the central cam body may be rotated for radially positioning a gripping jaw within each window by rotation of the tong housing and the windows relative to the central cam body and the shaft on which it is received. Each gripping jaw may be movably secured to the central cam body to prevent loss of the gripping jaw from the tong housing due to excessive displacement of the gripping jaw through the window in which the gripping jaw is slidably received. In one embodiment, the gripping jaw is movably secured to the central cam body using a generally T-shaped retainer stem that penetrates the gripping jaw and is received and secured within a generally T-shaped channel within the central cam body.

Figure 2A:
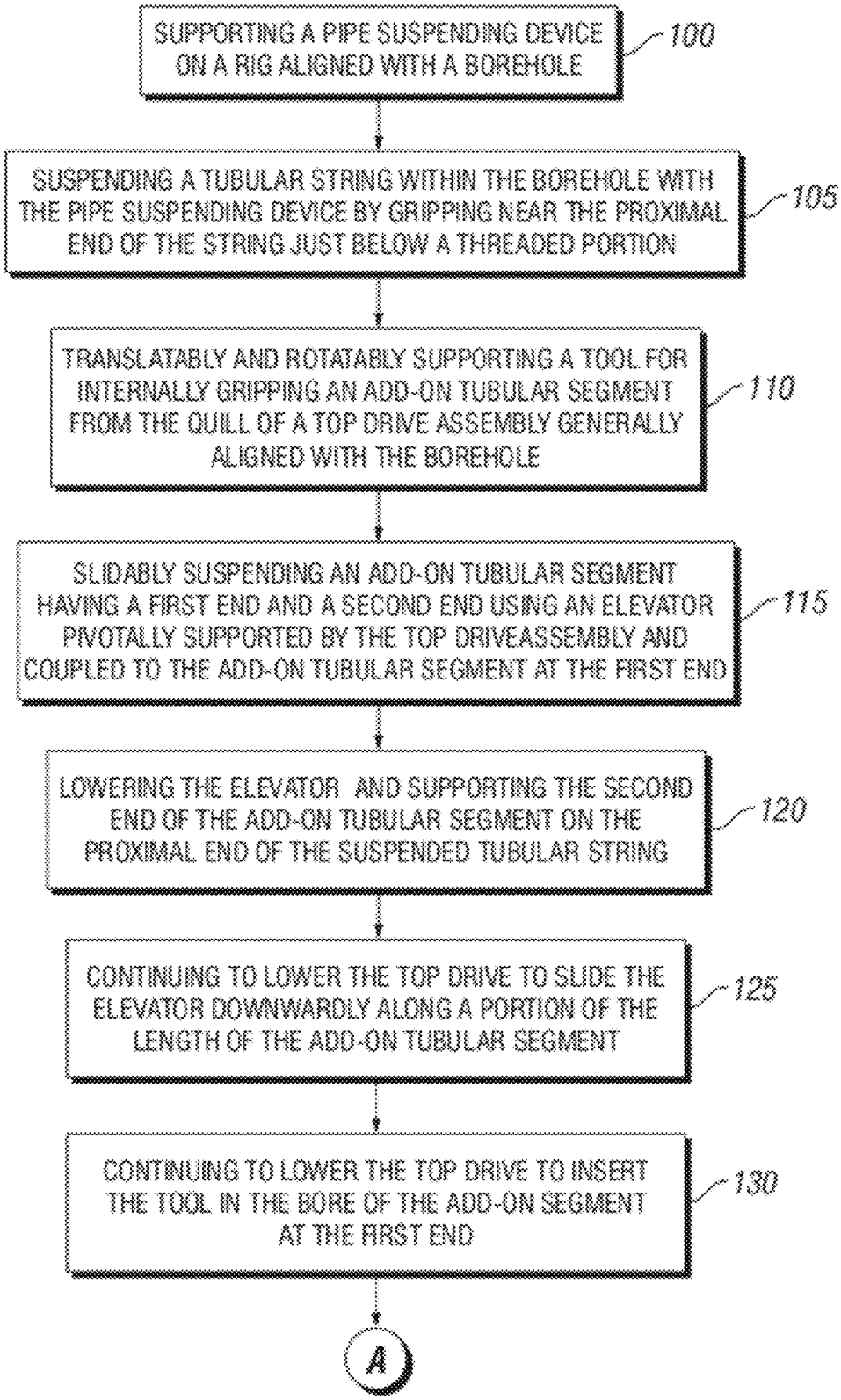
FIGS. 2A and 2B together are together a flow chart illustrating the steps of one embodiment of the method of the present invention for making up and running a tubular string into a borehole.
Figure 2B:
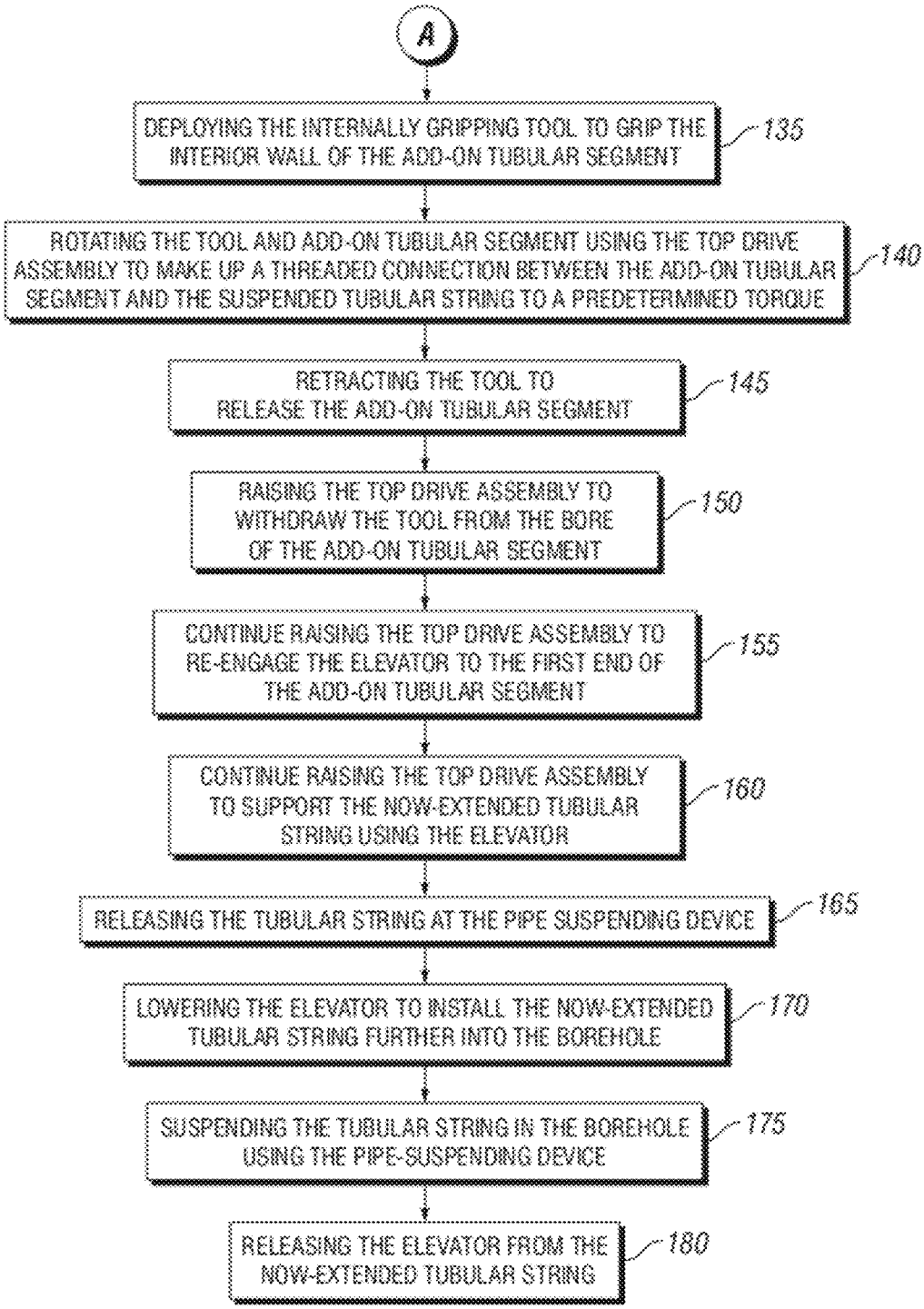

The above-described embodiments of the internally gripping power tong are structures that may be used to implement the method of the present invention. FIGS. 2A and 2B together are a high level flow chart illustrating the steps of one embodiment of the method of the present invention for making up and running a tubular string into a borehole. In step 100, a pipe suspending device is supported on a rig in a position generally aligned with a drilled borehole. In step 105, a tubular string is supported within the borehole by engaging the tubular string near its uppermost end just below a threaded portion used to couple the tubular string to a tubular segment. In step 110, a tool for internally gripping a tubular segment is translatably and rotatably supported from the top drive assembly quill in a generally aligned position with the borehole and with the tubular string suspended within the borehole by the pipe suspending device. In step 115, a tubular segment is slidably suspended in a generally vertical position using an elevator that is pivotally coupled to the top drive assembly using bails. Tubular strings having threaded connections may be formed using the "pin down" method or the "pin up" method. Where the "pin down" method of forming and running the tubular string is used, the elevator may engage a sleeve at the upper, box end of the tubular segment to dispose the lower, pin end downwardly toward the proximal and threaded box end of the tubular string that is suspended within the borehole by the pipe suspending device, such as a spider. It should be understood that devices such as collars, nubbins and inserts may be used to facilitate the use of the method of the present invention for making up and running tubular strings using either the "pin up" or "pin down" methods, and for conventional threaded connections, integral threaded connections, etc.

In step 120, the top drive assembly, the internally gripping tool, the elevator and the tubular segment supported within the elevator are lowered to cause the lower, second end of the tubular segment to bear upon the proximal end of the suspended tubular string. More specifically, if the "pin down" method is used, the lower, second end of the tubular segment is an externally threaded "pin end" of the tubular segment, and the proximal end of the suspended tubular string is an internally threaded sleeve or "box end" of the tubular string, and the externally threaded "pin end" of the tubular segment is received within the internally threaded "box end," and the tubular segment will be supported by the proximal, box end of the suspended tubular string if the elevator is lowered further.

In step 125, the top drive assembly, the internally gripping tool and the elevator are lowered further to cause the string elevator to slide downwardly along at least a portion of the length of the tubular segment that is supported at its lower, second end by the proximal end of the suspended tubular string. In step 130, the elevator is lowered further to insert the tool (the internally gripping power tong) into the aligned bore of the tubular segment at its upper, first end. In step 135, the internally gripping power tong is deployed to engage and grip the interior wall of the tubular segment. In step 140, the internally gripping power tong is rotated using the quill of the top drive assembly to make-up the threaded connection between the lower, second end of the tubular segment and the proximal end of the suspended tubular string to a predetermined torque.

In step 145, the gripping jaws of the tool are retracted to release the interior wall of the tubular segment. In step 150, the top drive assembly is raised to withdraw the tool from the bore of the tubular segment at its first end. The tubular segment is now the uppermost portion of the now-lengthened tubular string. In step 155, the top drive assembly, bails and the elevator are raised further to reengage the elevator with the first end of the tubular segment. In step 160, the top drive assembly, bails and the elevator are raised further to support the now-lengthened tubular string from the elevator, and to unload the pipe suspending device. In step 165, the pipe suspending device is disengaged from the now-lengthened tubular string. In step 170, the elevator is lowered to install the now-lengthened tubular string further into the borehole. In step 175, the pipe suspending device is reengaged to grip and suspend the now-lengthened tubular string within the borehole with the first end of the tubular segment positioned just above the pipe suspending device to receive and support an additional tubular segment to be introduced using the elevator after it is released from the tubular string in step 180. Finally, in step 180, the elevator is released from the first end of the tubular segment, and it is available to receive and support and additional tubular segment to begin the cycle again. This cycle is repeated until the tubular string reaches the desired length.

Figure 3:
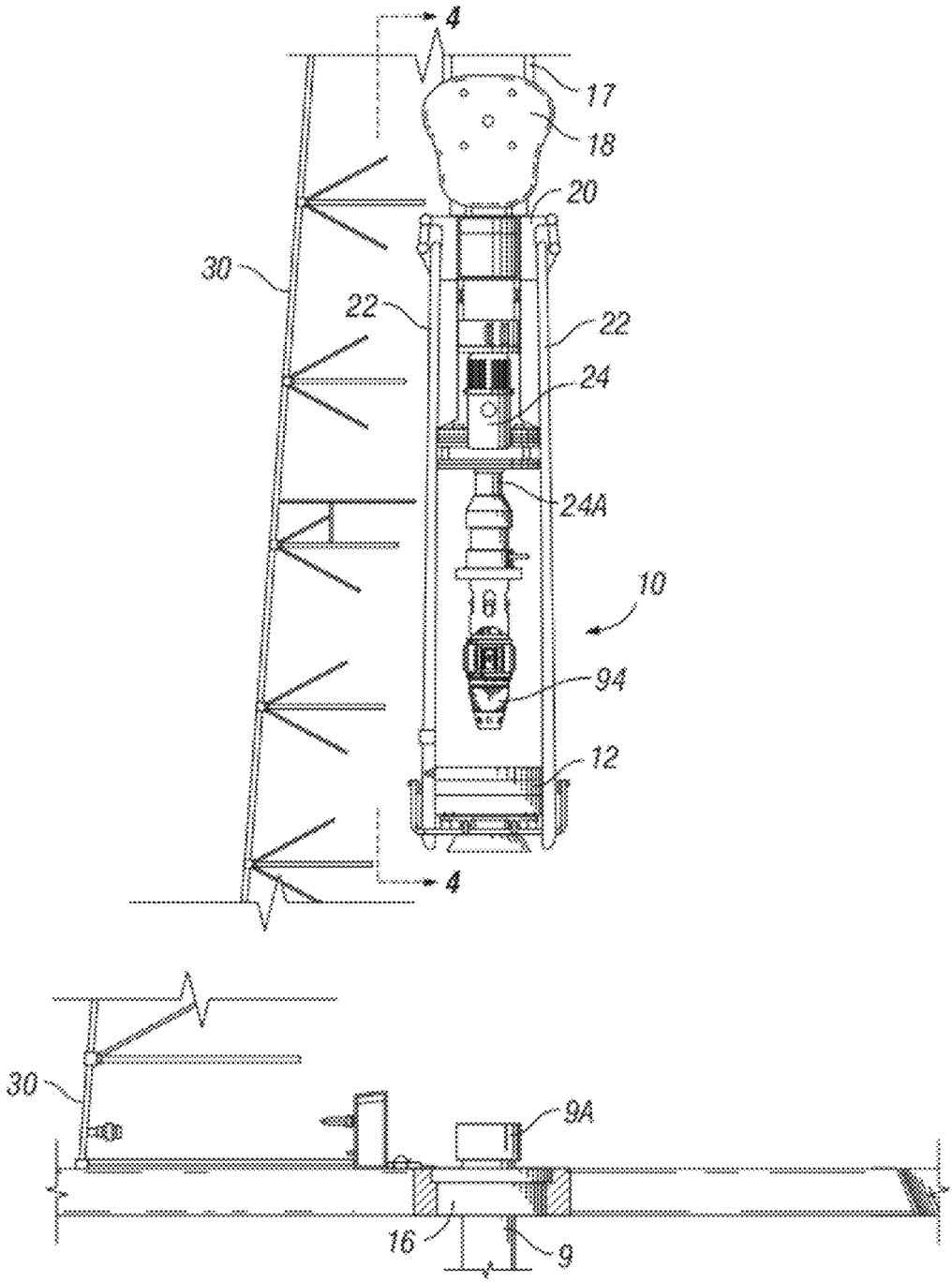
FIG. 3 is an elevation frontal view of a rig having a support structure, a traveling block, wire rope and related drawworks for movably supporting a top drive assembly and one embodiment of the internally gripping power tong of the present invention in an aligned position with the tubular string suspended in a borehole using a spider.

FIG. 3 is an elevation view of a rig support structure 30 for movably supporting a top drive assembly 24. The top drive assembly 24 includes a collar ring 20, and the top drive assembly is supported by a traveling block 18 and wire rope 17 to enable controlled movement of the top drive assembly 24 in a generally vertical path aligned with the tubular string 9 that is suspended within a borehole (not shown) using a pipe suspending device, such as a spider 16. The proximal end 9A of the tubular string 9 is positioned for receiving and being coupled to a tubular segment 8 (shown in FIG. 4).

Figure 4:
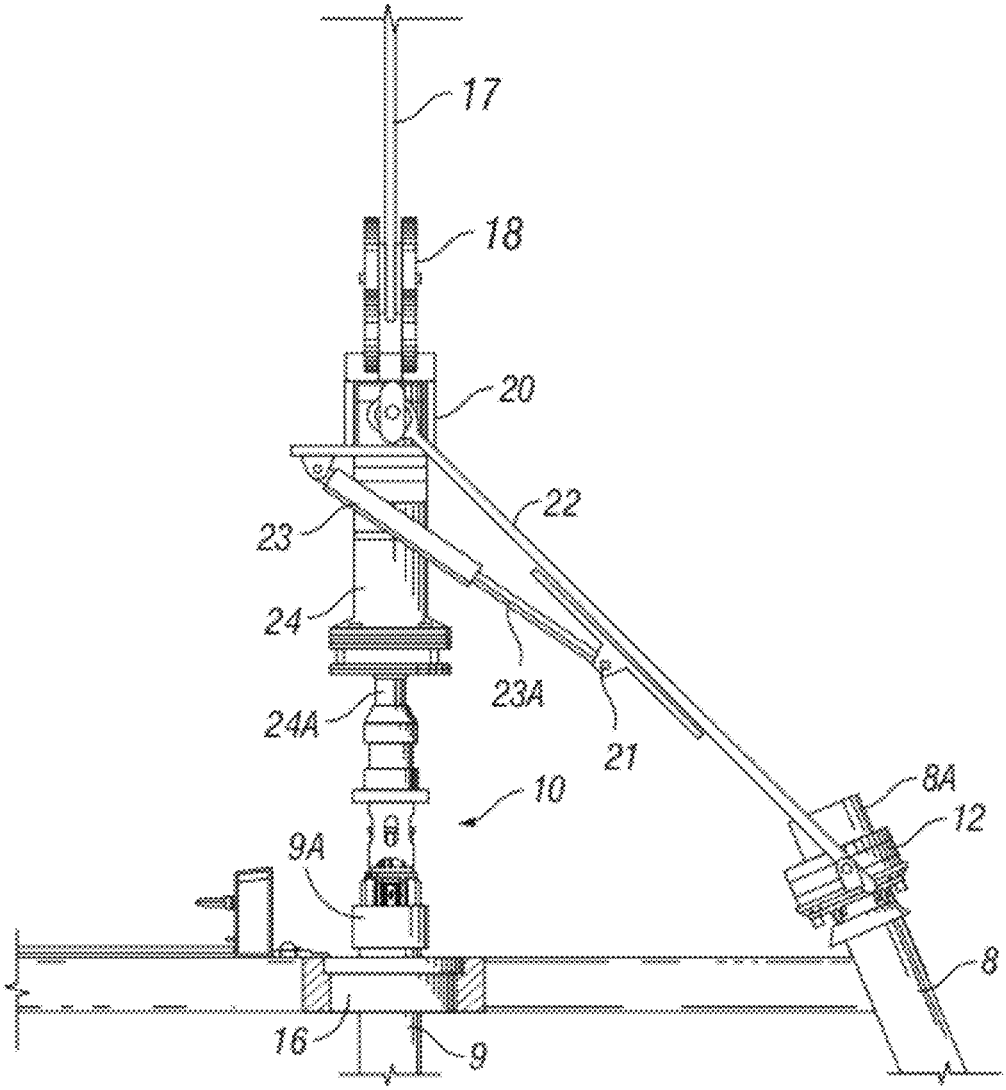
FIG. 4 is an elevation side view of the embodiment of the internally gripping tong of FIG. 3 lowered to a position closer to the spider and partially within the suspended tubular string as the bails are hydraulically disposed at a substantial angle to the generally vertical axis of rotation of the quill of the top drive assembly and the internally gripping power tong to access and engage a tubular segment to be brought to well center and joined to the suspended tubular string using the internally gripping power tong.

FIG. 3 shows that the collar ring 20 suspends the elevator 12 using elongate bails 22. The bails 22 may be generally pivotable about the collar ring 20. As shown in FIG. 4, the elevator 12 may be positionable using hydraulic cylinders 23 to pivot the bails 22, and the elevator 12 supported by the bails 22, out of its position aligned with the top drive assembly and the borehole to engage, support and position a tubular segment 8 for coupling to the tubular string 9 suspended in the borehole.

Returning to FIG. 3, the top drive assembly 24 also rotatably supports the internally gripping power tong 10 of the present invention from the rotatable quill 24A of the top drive assembly 24. The internally gripping power tong 10 is generally aligned with the elevator 12 when the elevator is aligned with the proximal end 9A of the suspended tubular string 9. This generally vertical pathway defined by the internally gripping power tong 10, the elevator 12 (when it is not "kicked out" using the cylinders 23 as shown in FIG. 4), and the proximal end 9A of the suspended tubular string 9 is referred to herein as "well center." The elevator 12 may be restored to well center or kicked out from well center by pivotally positioning the bails 22 using the cylinders 23 (see FIG. 4), or simply by allowing gravity to restore the elevator to well center. If conventional threaded connections are being used to join tubular segments to form a tubular string, then the proximal end 9A of the tubular string 9 comprises an internally threaded sleeve or "box end" connection 9A threadably received onto the proximal end of the tubular string 9 and configured to receive and support the lower "pin end" connection 8B (not shown in FIG. 3, see FIGS. 5-7) of a tubular segment 8.

Figure 5:
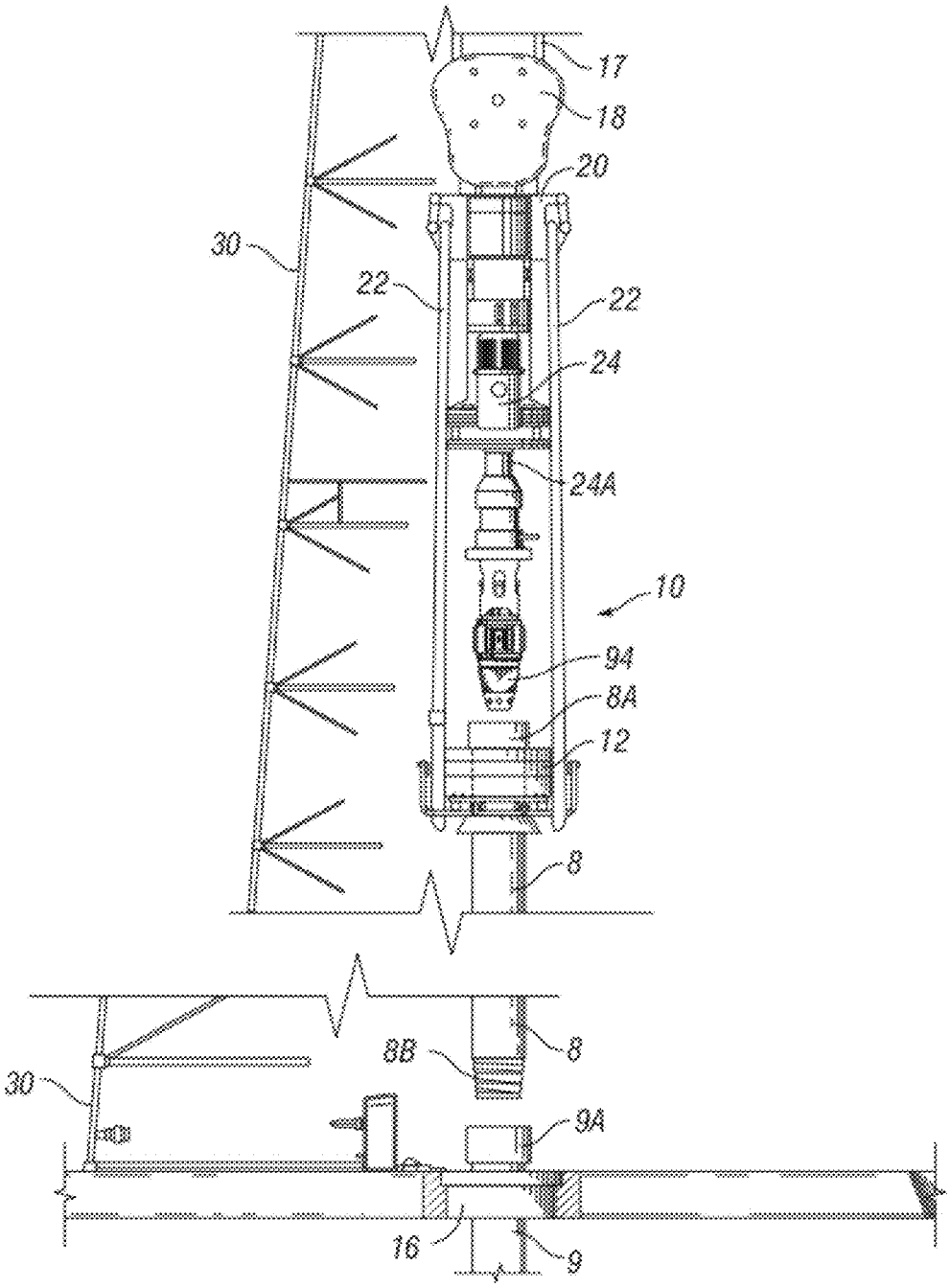
FIG. 5 is the elevation view of FIG. 3 after the tubular segment has been moved by the hydraulically-powered bails to an aligned position with the suspended tubular string and the internally gripping power tong, with the lower end of the tubular segment positioned above and aligned with the proximal end of the suspended tubular string.

FIG. 5 is the frontal elevation view of FIG. 3 after the tubular segment 8 is positioned at well center using the equipment described above and relating to FIG. 4. The tubular segment 8 is suspended by the elevator 12 intermediate and aligned with the internally gripping power tong 10 that is rotatably suspended from the quill 24A of the top drive assembly 24 and also with the proximal end 9A of the tubular string 9 that is suspended within the borehole by the spider 16. The upper, box end connection 8A of the tubular segment 8 is shown protruding above the elevator 12. The lower, pin end connection 8B of the tubular segment 8 is positioned to be lowered using the traveling block 18, and then received and supported within the box end connection at the proximal end 9A of the tubular string 9.

Figure 6:
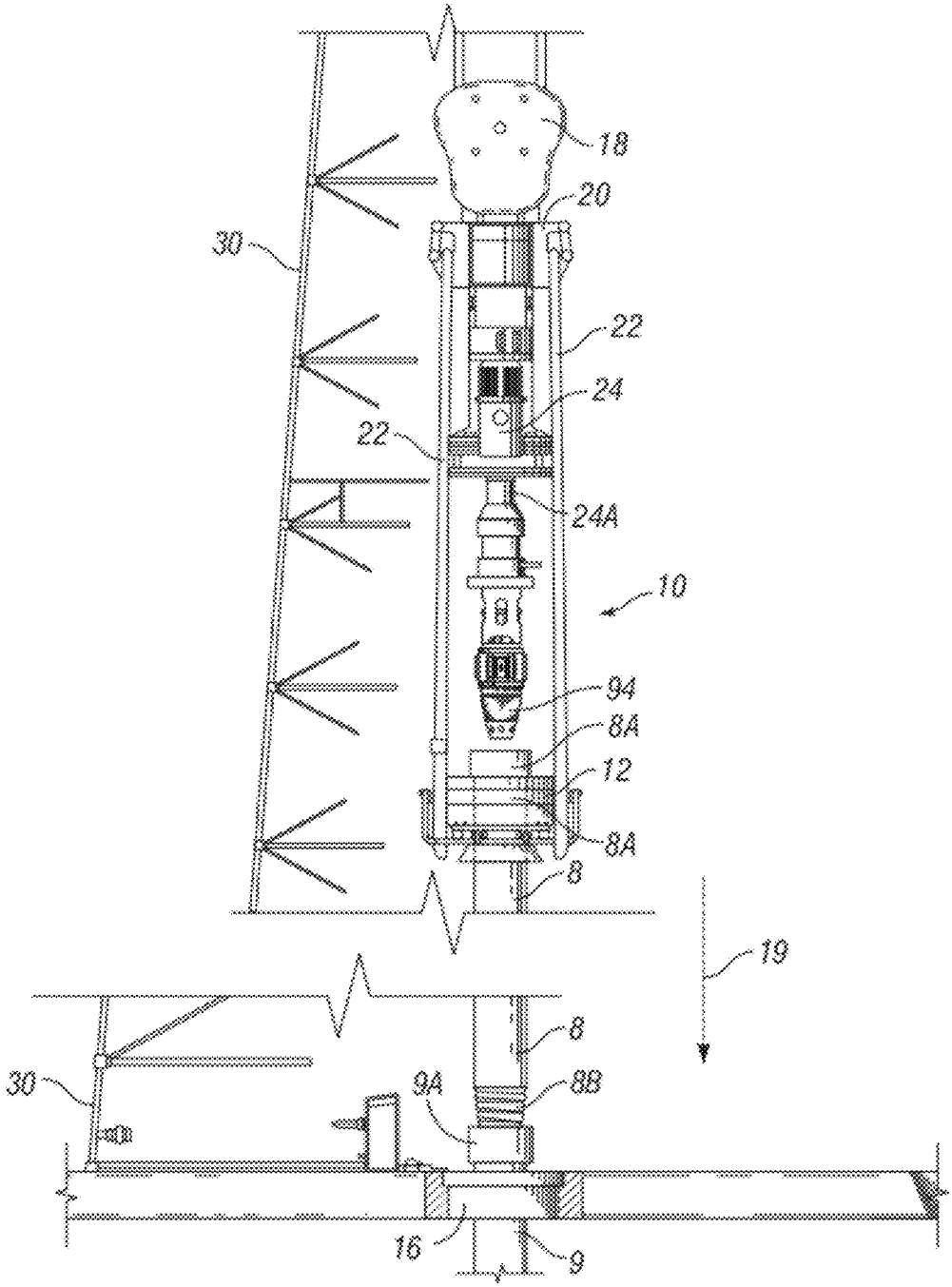
FIG. 6 is the elevation view of FIG. 5 after the top drive assembly is lowered further to permit the lower end of the tubular segment to bear against and be supported by the proximal end of the suspended tubular string.

FIG. 6 is the frontal elevation view of FIG. 5 after the traveling block 18 has been used to lower and reposition the tubular segment 8 in the direction of arrow 19 so that the lower, pin end 8B of the tubular segment 8 contacts and then bears against the proximal, box end 9A of the suspended tubular string 9. At the position shown in FIG. 6, at least a substantial portion of the weight of the tubular segment 8 is supported by the proximal, box end 9A of the of the suspended tubular string 9, and subsequent rotation of the tubular segment 8 in the make-up direction using the rotatable quill of the top drive assembly 24 will cause the pin end 8B of the tubular segment 8 to be threadably coupled to the box end 9A of the tubular string 9 to lengthen the tubular string 9. (It should be recognized that the "make-up" direction of rotation depends on whether the threads are right-handed or left-handed.)

Figure 7:
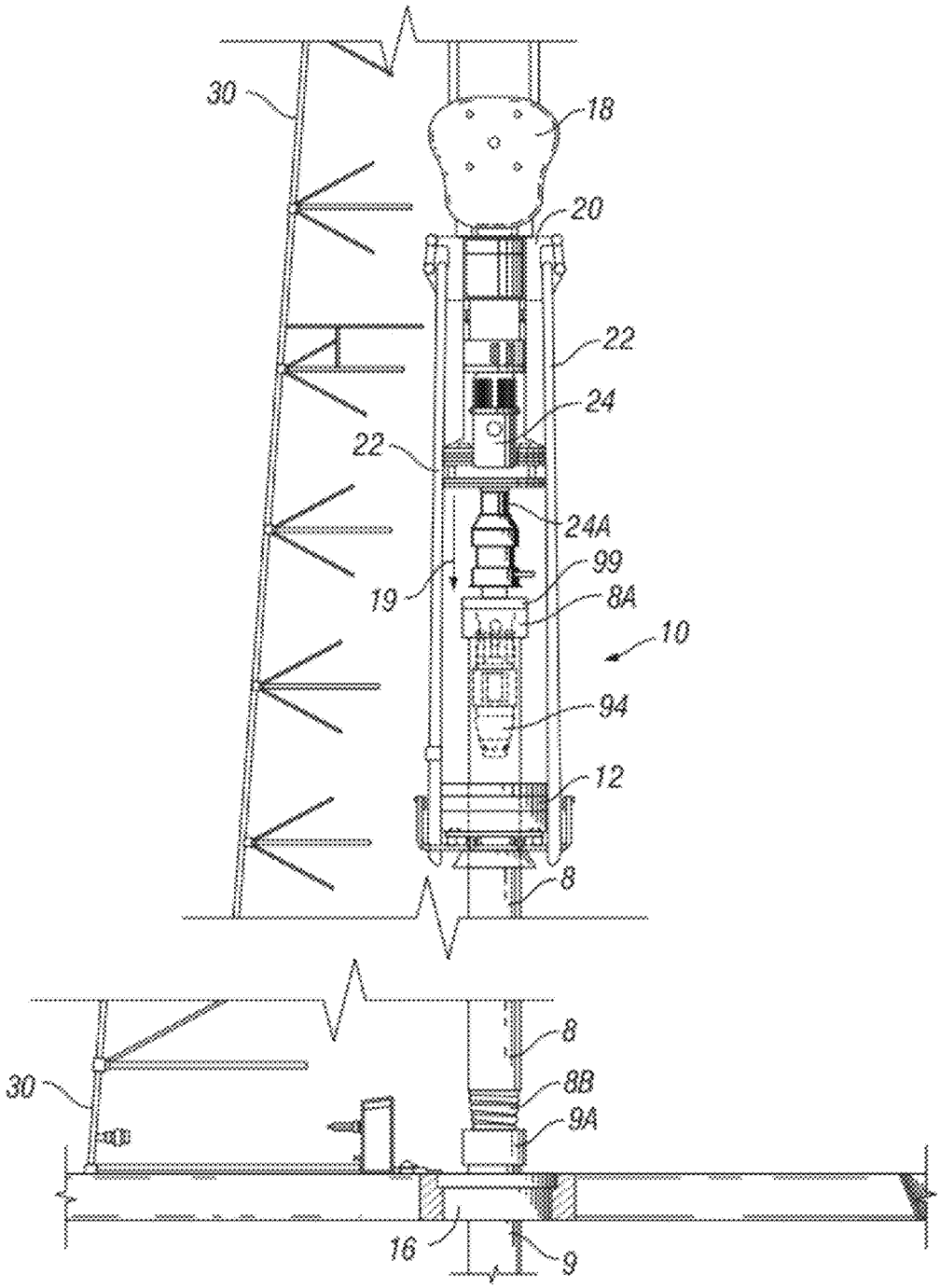
FIG. 7 is the elevation view of FIG. 6 after the top drive assembly is lowered further to cause the elevator to slide downwardly along at least a portion of the length of the tubular segment, and to cause the internally gripping power tong of the present invention to be inserted into the bore of the tubular segment. The portion of the internally gripping power tong within the bore of the tubular segment is shown in dotted lines.

FIG. 7 is the frontal elevation view of FIG. 6 after the traveling block 18 is used to further lower the top drive assembly 24, the ring collar 20, bails 22, and elevator 12 in the direction of arrow 19 to cause the elevator 12 to slide downwardly along at least a portion of the length of the tubular segment 8 and to cause the internally gripping power tong 10 to be inserted into the bore of the tubular segment 8 at its upper, top end 8A. The internally gripping power tong 10 is shown in dotted lines within the bore of the tubular segment 8, and the top, box end 8A of the tubular segment 8 is shown adjacent to or contacting the stop plate 99 that limits the extent to which the internally gripping power tong 10 may be inserted into the bore of the tubular segment 8. The protective guide 94 is generally tapered toward its lower end to facilitate entry of the internally gripping power tong 10 into the upper end 8A of the tubular segment 8.

Figure 8:
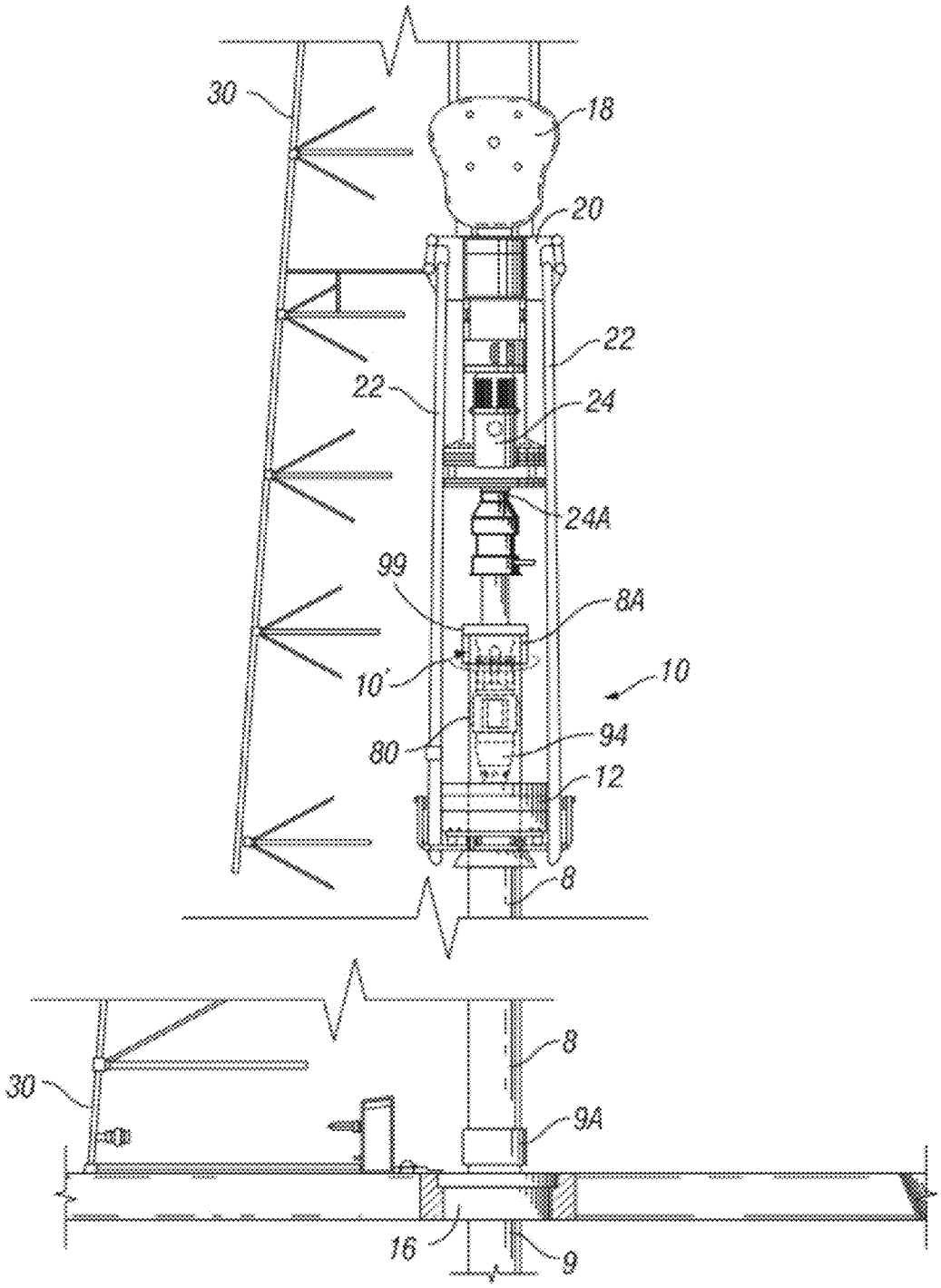
FIG. 8 is the elevation view of FIG. 7 after the internally gripping power tong is deployed to grip the interior wall of the tubular segment and the internally gripping power tong has been rotated by the quill of the top drive assembly to make-up the threaded connection between the lower end of the tubular segment and the proximal end of the suspended tubular string.

FIG. 8 is the frontal elevation view of FIG. 7 after the top, box end 8A of the tubular segment 8 is abutted to the stop plate 99 and the internally gripping power tong 10 is deployed (in a manner described in more detail below in relation to FIGS. 13A-14C) to grip the interior wall of the tubular segment 8, and the top drive assembly 24 has rotated the quill 24A, the internally gripping power tong 10 and the gripped tubular segment 8 about the axis of the tubular segment 8 in the direction of arrow 10' (assuming the connections use right-handed threads) to threadably make-up the connection between the lower, pin end 8B of the tubular segment 8 and the proximal, box end 9A of the suspended tubular string 9. The internally gripping power tong 10 is shown in its extended position by operation of the thread compensation assembly, which is discussed in more detail below in relation to FIG. 12. The thread compensation assembly functions to lower the tong housing, the central cam body and the gripping jaws of the internally gripping power tong 10 as the make-up of the threaded connection draws the tubular segment 8 downwardly.

Figure 9:
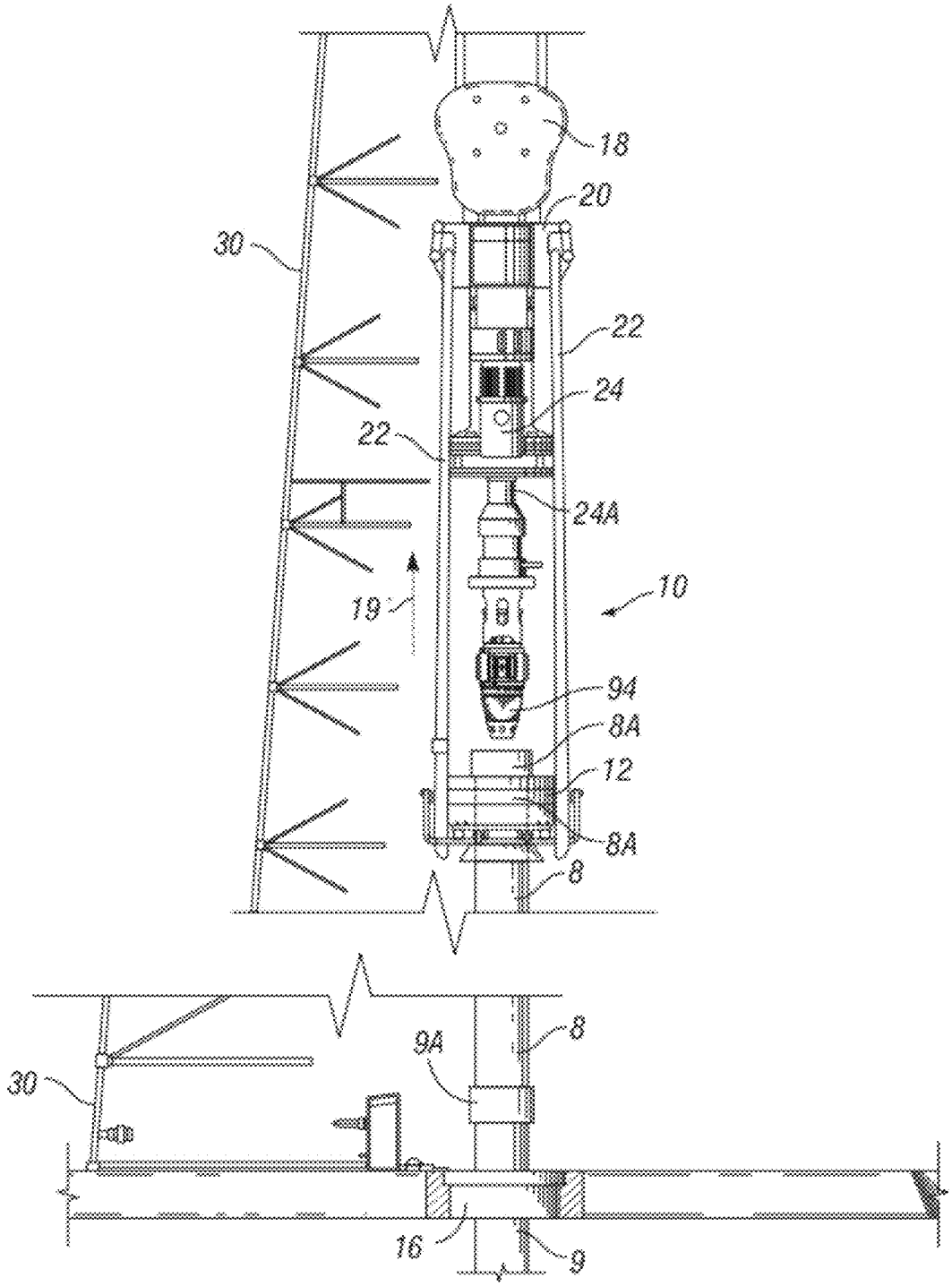
FIG. 9 is the elevation view of FIG. 8 after the top drive assembly is raised and the elevator is reengaged with the upper end of the now-added tubular segment to suspend the now-lengthened tubular string and to unload the spider.

FIG. 9 is the frontal elevation view of FIG. 8 after the traveling block 18 is used to raise the top drive assembly 24, ring collar 20, bails 22 and elevator 12 in the direction of arrow 19' to cause the elevator 12 to slide back up along the portion of the length of the tubular segment 8 and to cause the internally gripping power tong 10 to be withdrawn from the bore of the tubular segment 8 at the upper, top end 8A. The internally gripping power tong 10 is shown above and aligned with the bore of the tubular segment 8, and the top, box end 8A of the tubular segment 8 is shown above the elevator 12. The now-lengthened tubular string 9, which now includes the threadably coupled tubular segment 8, is shown to be lifted a short distance from its suspended position shown in FIGS. 3-8 to unload the slips of the spider 16 so that the now-lengthened tubular string 9 can be lowered further into the borehole.

Figure 10:
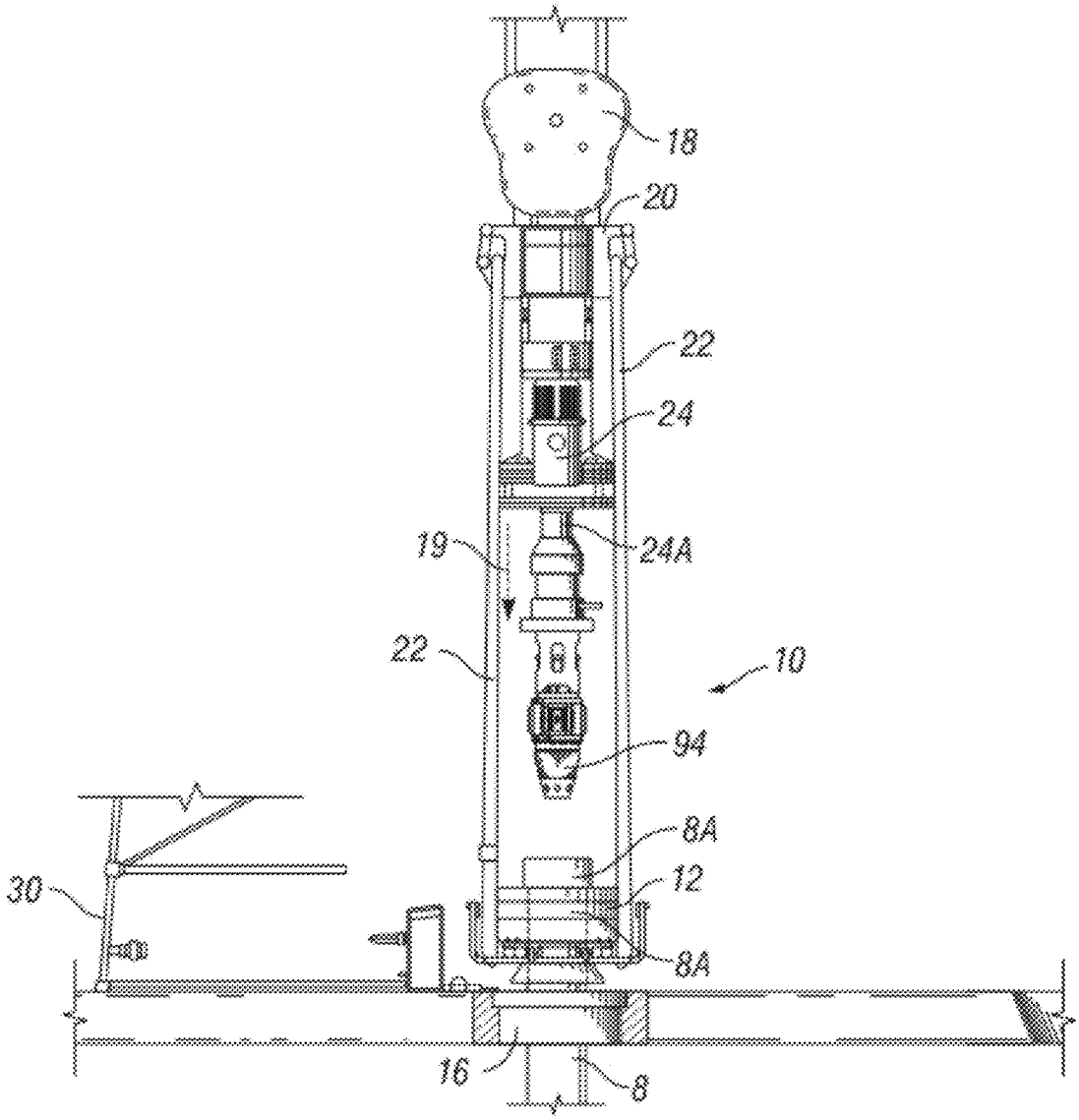
FIG. 10 is the elevation view of FIG. 9 after the now-lengthened tubular string has been lowered to position the upper end of the now-added tubular segment just above the spider, and the spider has been reengaged to grip and suspend the now-lengthened tubular string in position to receive and couple to an additional tubular segment.

FIG. 10 is the frontal elevation view of FIG. 9 after the traveling block 18 is used to lower the collar ring 20, bails 22, elevator 12 and the tubular segment 8 (now the uppermost portion of the tubular string 9 shown in FIG. 9) in the direction of arrow 19 to a favorable position for being reengaged by the spider 16 and for being again suspended in the borehole. After the tubular segment 8 (and the tubular string of which the tubular segment is now a part) is suspended in the borehole as shown in FIG. 10, the elevator 12 is released from the tubular segment 8 and raised so that a new tubular segment (not shown in FIG. 10) can be secured to the elevator 12 and positioned at well center generally in alignment with the top end 8A of the tubular segment 8 for being joined to the upper, box end 8A of the tubular segment 8 to further lengthen the tubular string 9.

FIGS. 11-16 are drawings that better reveal the structure of the embodiment of the internally gripping power tong 10 of the present invention shown in FIGS. 3-10.

Figure 11:
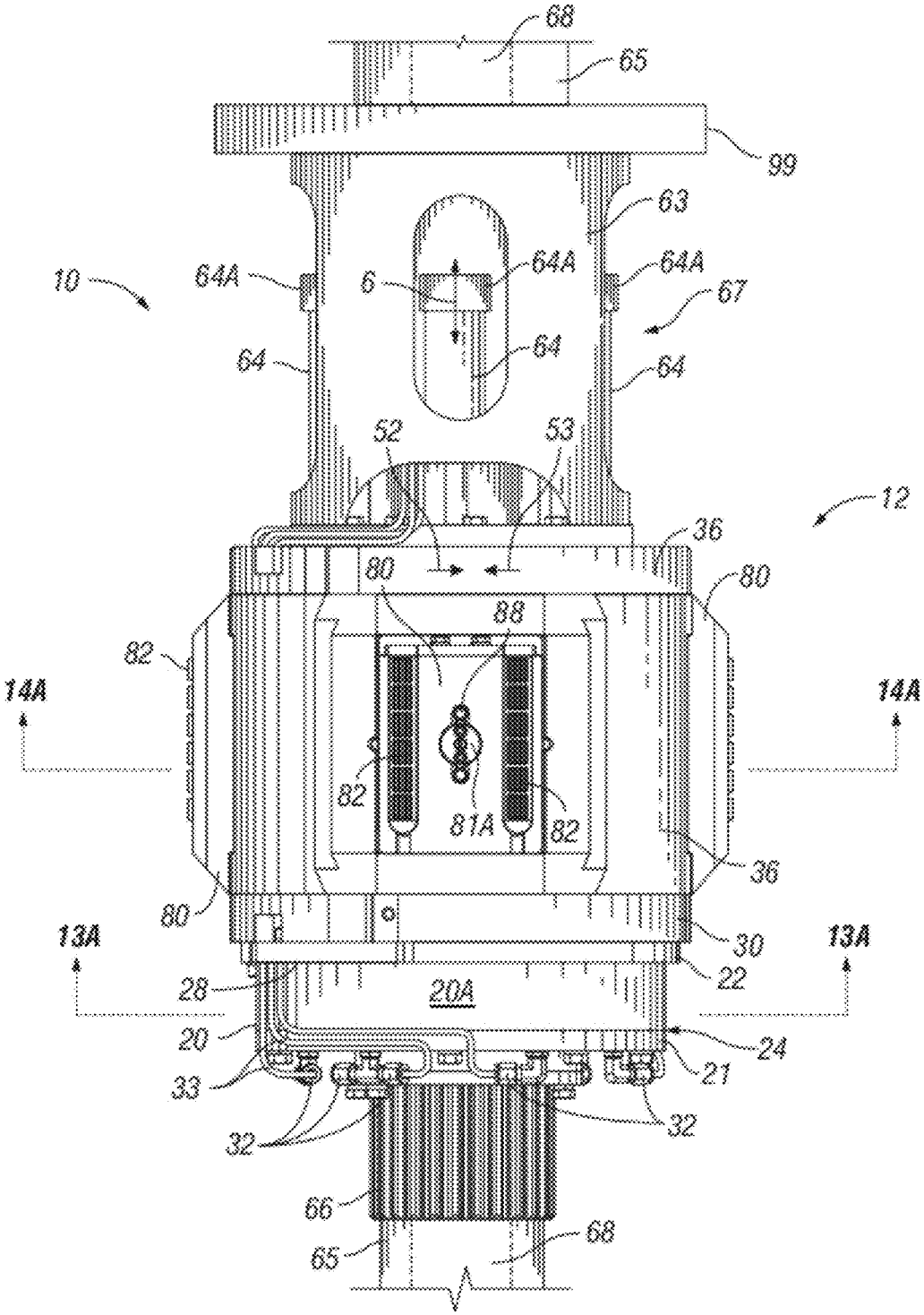
FIG. 11 is an enlarged elevation view of the embodiment of the internally gripping power tong shown in FIGS. 3-10, but with the lower insertion guide removed to reveal the hydraulic lines used to operate the rotary vaned actuator assembly.

FIG. 11 is an enlarged elevation view of the preferred embodiment of the internally gripping power tong 10 shown in FIGS. 3-10, but with the protective guide 94 removed to reveal the hydraulic tubing 33 and related fittings 32 used to operate the rotary vaned actuator assembly (see FIGS. 13A-14C). The internally gripping power tong 10 comprises a shaft 65, a gripping assembly 12, a rotary vaned actuator assembly 20 and a thread compensation assembly 67. The gripping assembly 12 comprises a generally tubular tong housing 36 having a plurality of angularly distributed windows (see elements 33A-33C in FIG. 15) therein, each window slidably receiving a deployable gripping jaw 80 for releasably gripping the interior bore of a tubular segment (not shown in FIG. 11) upon deployment of the gripping assembly 12 by hydraulic operation of the rotary vaned actuator assembly 20. The internally gripping power tong 10 further comprises a shaft 65 having an axially-splined portion 66 and a hollow interior fluid passage 68 disposed generally along the axis of rotation 6 of the internally gripping tong 10. The deployable gripping jaws 80 may be fitted with removable gripping dies 82 for improved gripping of the interior wall of a tubular segment. The gripping dies may also be selected and installed to vary the range of diameters of tubular segments that may be gripped by the internally gripping power tong 10.

The gripping assembly 12, including the tong housing 36 and the gripping jaws 80 slidably captured in the windows 33A-33C (not shown in FIG. 11—see FIG. 15) therein, is positionable within a limited range of movement along the splined portion 66 of the shaft 65 by operation of the thread compensation assembly 67. The thread compensation assembly 67 is shown in FIG. 11 to be in its retracted position with the spacer 63 and the attached stop plate 99 in their uppermost position. In the embodiment of the internally gripping power tong 10 shown in FIG. 11, the stop plate 99 serves the dual purposes of limiting the extent of extension of the thread compensation assembly 67, and also limiting the extent to which the internally gripping power tong 10 can be inserted into the bore of a tubular segment having a diameter of equal to or less than the diameter of the stop plate 99. Similarly, the guides 64 may each comprise a stop head 64A for abutting the stop plate 99 and thereby limiting the extension of the thread compensation assembly 67.

The internally gripping power tong 10 of FIG. 11 further comprises a rotary vaned actuator assembly 20 comprising a first (bottom) plate 21 and a second (top) plate 22 secured to opposite sides of a generally cylindrical actuator housing 20A to form a closed cylindrical chamber there within. The second (top) plate 22 is securable to the bottom of the tong housing 36 of the gripping assembly 12. The rotary vaned actuator assembly 20 further comprises other components that will be discussed later in relation to FIGS. 13A-13C.

Figure 12:
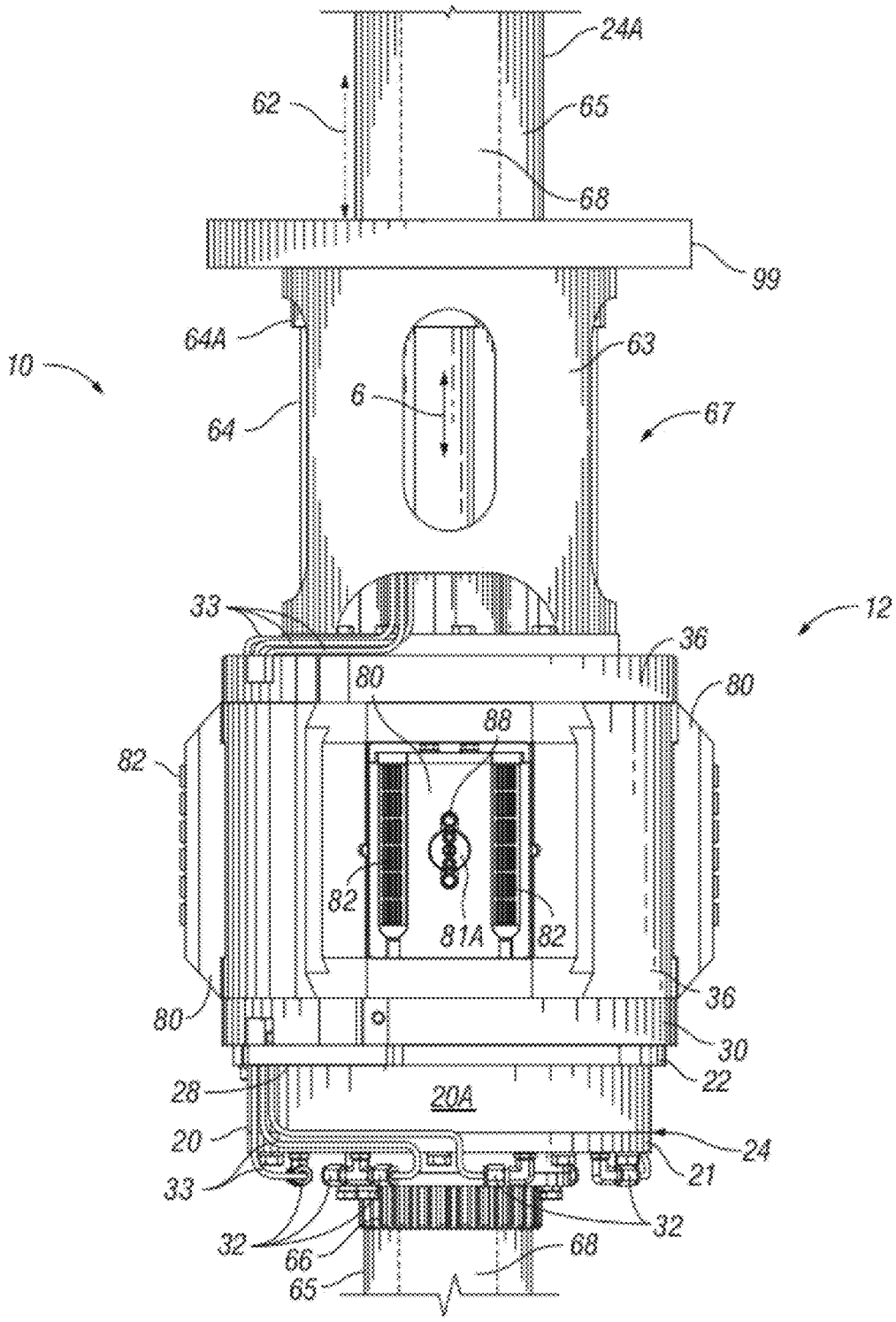
FIG. 12 is the enlarged elevation view of the internally gripping power tong of FIG. 11 with the thread compensation assembly deployed to reposition the gripping assembly downwardly along the splined portion of the hollow shaft to correspond to the position shown in FIG. 8.

FIG. 12 is the enlarged elevation view of FIG. 11 after the thread compensation assembly 67 is extended to reposition the gripping assembly 12 lower on the splined portion 66 of the shaft 65 as would occur as a threaded connection is made up as depicted in FIG. 8 (as compared to FIG. 7. The thread compensation assembly 67 is adapted for repositioning the gripping assembly 12 and the gripped tubular segment (not shown in FIG. 12) as the internally gripping tong 10 rotates to compensate for axial overlapping as thread make-up between the tubular segment and the suspended tubular string is achieved. For single start threads, for example, the thread compensation system 67 might reposition the gripping assembly 12 along the splined portion 66 of the shaft 65 at a rate of movement determined by the geometry of the threads of the threaded connection being made up between the tubular segment and the tubular string (in inches per thread) times the rotational velocity of the internally gripping power tong (in revolutions per minute) as produced by rotation of the quill 24A of the top drive assembly 24 (not shown in FIG. 12—see FIGS. 3-10), wherein each revolution of the tubular segment advances the make-up of the threaded connection by one thread.

The thread compensation assembly 67 may comprise one or more coil springs or other types of springs, pneumatic bladders, hydraulic cylinders or other such variable members for vertically positioning the gripping assembly 12 and a tubular segment gripped by the gripping assembly, as is shown in FIGS. 7 and 8. The thread compensation assembly 67 also provides for gradual movement of the gripping assembly 12, including the tong housing 36, the gripping jaws 80, and the central cam body (not shown in FIG. 12—see FIG. 14A-14C) along the splined portion 66 of the hollow shaft 65 as the threads are made-up or broken-out between the tubular segment and the tubular string.

Figure 13A:
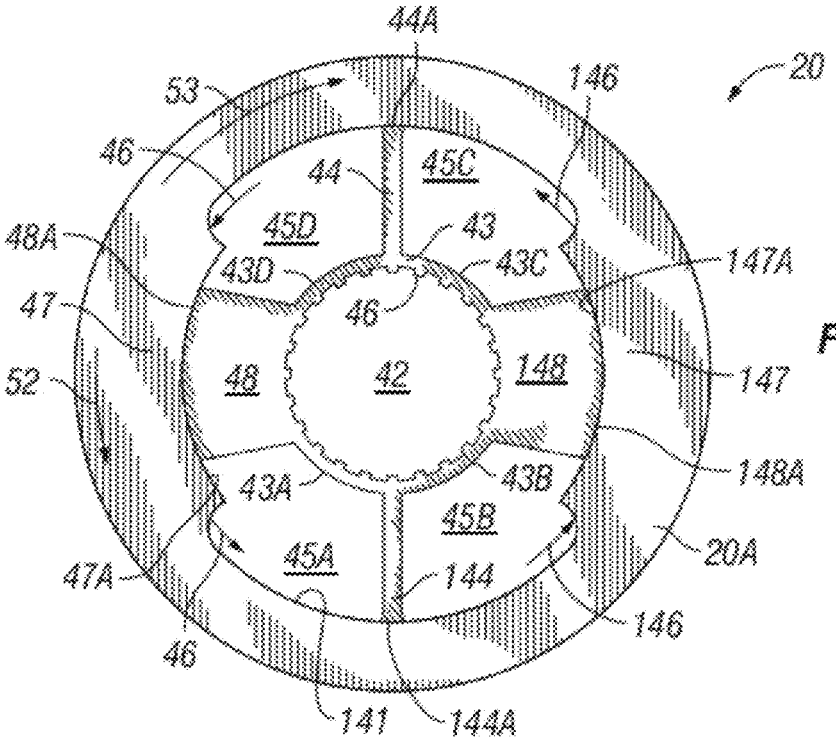
FIG. 13A is a horizontal cross-section view of one embodiment of the internally gripping power tong of FIG. 3 revealing the components of the rotary vaned actuator assembly prior to deployment and corresponding to the position of the gripping jaws and central cam body shown in FIG. 14A.
Figure 13B:
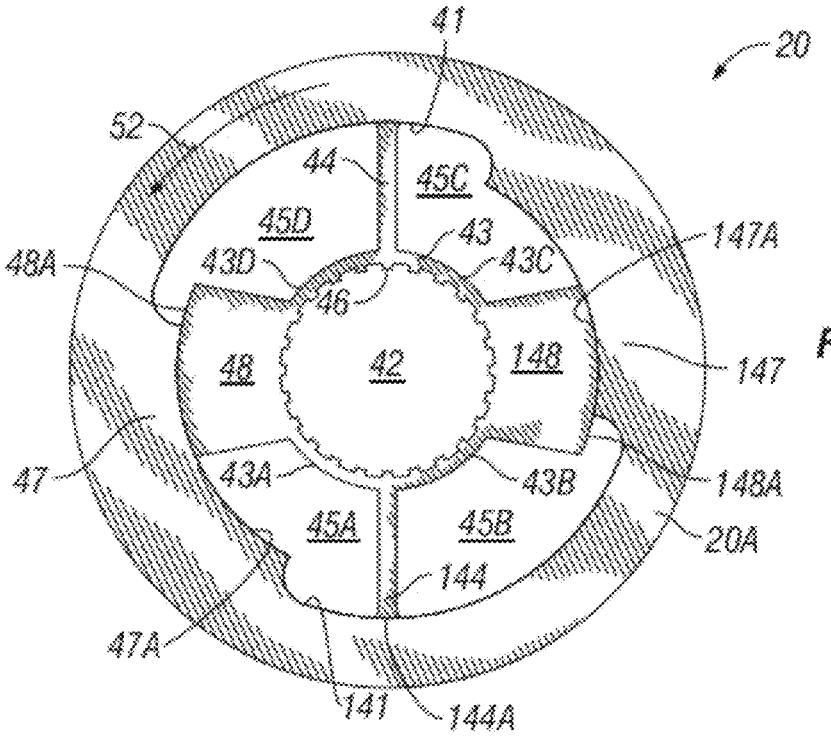
FIG. 13B is the horizontal cross-section view of the internally gripping power tong of FIG. 13A revealing the tubular tong housing rotated counterclockwise from its position shown in FIG. 13A to deploy the gripping jaws to the make-up position illustrated in FIG. 14B.
Figure 13C:
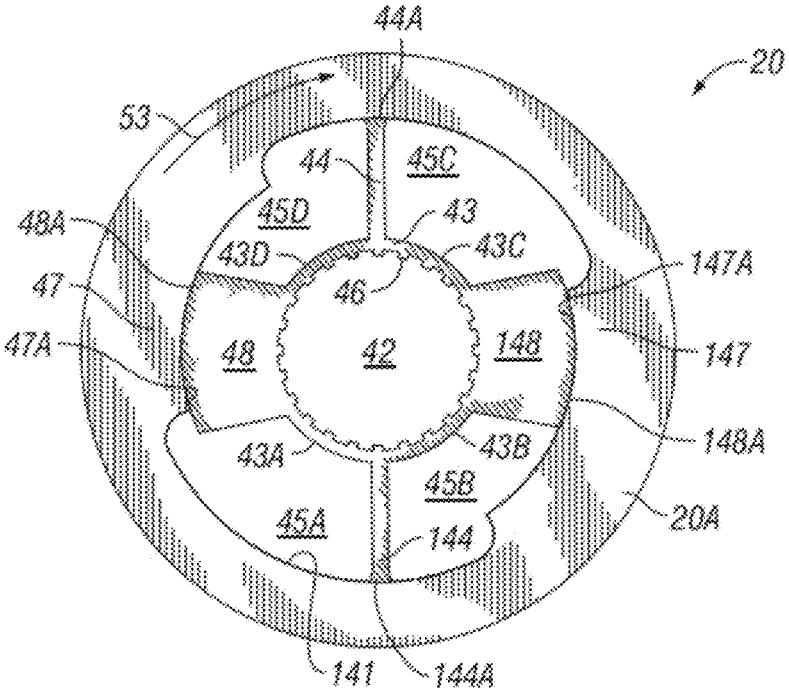
FIG. 13C is a horizontal cross-section view of the internally gripping power tong of FIG. 13A revealing the tubular tong housing rotated clockwise from its position shown in FIG. 13A to deploy the gripping jaws to the break-out position illustrated in FIG. 14C.

The operation of the rotary vaned actuator assembly 20 is described by FIGS. 13A-13C. FIG. 13A is horizontal cross-section view of one embodiment of the rotary vaned actuator assembly 20 that, when operated, deploys and retracts gripping jaws of the gripping assembly 12. As shown in FIG. 11, the actuator housing 20A of the rotary vaned actuator 20 is coupled to the tong housing 36 of the gripping assembly 12 through plate 22 so that rotation imparted to the actuator housing 20A relative to the splined shaft 65 causes rotation of the tong housing 36 relative to the splined shaft and the central cam body 77 that is slidably received thereon. Returning to FIG. 13A, the vaned assembly 43 is rotatable within the actuator housing 20A, and it is also axially received on and slidable along the splined portion 66 of the shaft 65 to permit axial sliding movement of the rotary vaned actuator assembly 20 along the splined portion 66 of the splined shaft 65 with the gripping assembly 12 as displaced by the thread compensation assembly 67 (see FIGS. 11 and 12). Specifically, the vaned assembly 43 is slidably received on, but rotatably locked to, the splined portion 66 of the hollow shaft 65 through interior splines 46 that surround the bore 42 of the vaned assembly 43. Operation of the rotary vaned actuator assembly 20 (in a manner described below) imparts rotation to the actuator housing 20A relative to the vaned assembly 43, and thereby imparts rotation to the tong housing 36 of the gripping assembly 12 relative to the central cam body 77 (shown in FIGS. 14A-14C) that is, like the vaned assembly 43, rotatably locked to the splined portion 66 of the shaft 65 through interior splines 76 that surround its bore 72. The rotation of the tong housing 36 relative to the central cam body 77 results in camming of the gripping jaws 80 radially outwardly to engage and grip the interior wall of the tubular segment in which the internally gripping tong 10 is inserted and deployed.

The rotary vaned actuator assembly 20 shown in FIG. 13A is adapted for deploying the gripping jaws 80 (not shown in FIG. 13A—see FIG. 14A) by rotation of the actuator housing 20A and the tong housing 36 in either the clockwise direction 52 (see FIG. 14A) or the counterclockwise direction 53. The embodiment of the vaned assembly 43 shown in FIGS. 13A-13C comprises a pair of generally opposed long vanes 44 and 144, and a pair of generally opposed peripheral piston riders 48 and 148, and a line drawn generally through the center of the opposed pair of long vanes 44, 144 is disposed generally perpendicular to a line drawn generally through the center of the opposed pair of peripheral piston riders 48, 148. It should be noted that this configuration of the vaned assembly 43 is but one of many configurations that may be used to impart rotation to the tong housing 36 relative to the central cam body 77 to deploy and retract the gripping jaws 80. The actuator housing 20A that generally surrounds the vaned assembly 43 comprises a first peripheral piston 47 and a second, opposed peripheral piston 147, each protruding radially inwardly from the interior portion of the actuator housing 20A toward the center bore 42 of the vaned assembly 43.

The first peripheral piston 47 comprises a generally arcuate sealing surface 47A for sealably engaging the seal 48A of the first peripheral piston rider 48, and the second peripheral piston 147 comprises a generally arcuate sealing surface 147A for sealably engaging the seal 148A of the second peripheral piston rider 148. Similarly, the actuator housing 20A comprises a first peripheral recess 41 and a second, opposed peripheral recess 141, each positioned along the periphery of the interior wall of the actuator housing 20A and between the peripheral piston 47 and the second peripheral piston 147. The first peripheral recess 41 comprises a generally arcuate sealing surface for sealably engaging the seal 44A of the first long vane 44 and the second peripheral recess 141 comprises a generally arcuate sealing surface for sealably engaging the seal 144A of the second long vane 141. The seals and vanes described herein, along with the generally circular plates 21 and 22 shown in FIG. 12, define four pressurizable hydraulic chambers 45A, 45B, 45C and 45D within the rotary vaned actuator assembly 19. Pressure may be selectively directed to the chambers by control of valves that may be selectively placed in fluid communication with a source of pressurized fluid, as from a pump, or a fluid reservoir that may be adapted for feeding the suction of the pump. Pressure may be introduced into one or more of the chambers by way of tubing 33 and fittings 32 that communicate through ports in plate 21 (see FIG. 12) and generally discharge into the chambers along interface 24.

FIGS. 13A-13C shows how the rotary vaned actuator assembly 43, actuator housing 20A with peripheral pistons 47 and 147, peripheral piston riders 48 and 148, peripheral recesses 41 and 141, and the plates 21 and 22 (not shown in FIGS. 13A-13C), together define four generally sealed expandable chambers 45A, 45B, 45C and 45D. Long vane 44 has a slidable seal 44A disposed at its terminus, and long vane 144 has a slidable seal 144A disposed at its terminus, each for slidably sealing against the arcuate sealing surfaces 41 and 141 of the interior of the housing 20, respectively. Similarly, peripheral piston rider 48 has a slidable seal disposed at its arcuate sealing surface 48A, and peripheral piston rider 148 has a slidable seal disposed at its arcuate sealing surface 148A, each for slidable and sealing engagement with the arcuate sealing surfaces 47A and 147A of the interior of the peripheral pistons 47 and 147, respectively, that protrude radially inwardly from the actuator housing 20A. The operation of the rotary vaned actuator assembly 20 of FIG. 13A involves pressurization of alternating chambers, for example 45B and 45D, defined by the seals, vanes, peripheral pistons, peripheral piston riders and plates as described above. Long vanes 44, 144 and peripheral piston riders 48, 148 extend from vaned assembly 43 and remain axially slidable on, but rotatably locked to, splined shaft 65, while the actuator housing 20A is controllably rotatable relative to the vaned assembly 43 and the splined shaft 65 by pressurizing alternating chambers to impose a pressure differential in the same rotational direction across each of the peripheral pistons 47, 147.

Chamber 45A is defined by the interior bore of the actuator housing 20A, the side of the second long vane 144 disposed toward the first peripheral piston rider 48, the side of the first peripheral piston rider 48 disposed toward the second long vane 144, and the radially outwardly disposed center portion 43A of the vaned assembly 43 there between. Chamber 45B is defined by the interior bore of the actuator housing 20A, the side of the second long vane 144 disposed toward the second short vane 148, the side of the second peripheral piston rider 148 disposed toward the second long vane 144, and the radially outwardly disposed center portion 43B of the vaned assembly 43 there between. Chamber 45C is defined by the interior bore of the actuator housing 20A, the side of the first long vane 44 disposed toward the second peripheral piston rider 148, the side of the second peripheral piston rider 148 disposed toward the first long vane 44, and the radially outwardly disposed portion 43C of the vaned assembly 43 there between. Chamber 45D is defined by the interior bore of the actuator housing 20A, the side of the first long vane 44 disposed toward the first peripheral piston rider 48, the side of the first peripheral piston rider 48 disposed toward the first long vane 44, and the radially outwardly disposed center portion 43D of the vaned assembly 43 there between. All of the four chambers described above are defined by, in addition to the components listed above, plates 21 and 22, which cannot be seen in FIGS. 13A-13C. Selective pressurization of chambers 45B and 45D will cause the actuator housing 20A to be biased in the direction of arrows 46 and 146, which indicate the direction of the resulting forces applied to peripheral pistons 47 and 147, respectively. As the peripheral pistons move in response to the forces 46 and 146, the pressurized chambers 45B and 45D will expand due to counterclockwise movement of the actuator housing 20A relative to the stationary vaned assembly 43.

Figure 14A:
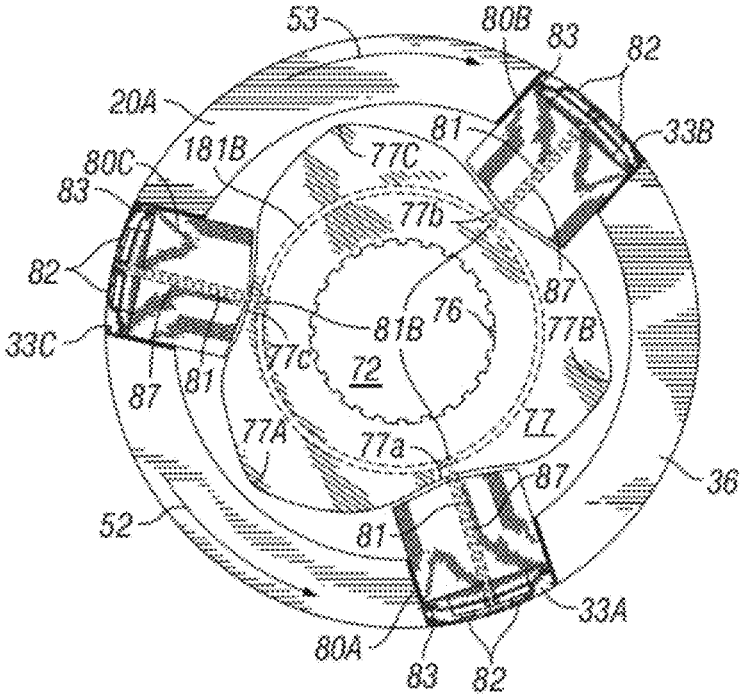
FIG. 14A is a horizontal cross-section view of the internally gripping power tong of FIG. 3 revealing the central cam body positioned to deploy the gripping jaws upon rotation of the tubular tong housing relative to the central cam body. This view corresponds to the position of the rotary vaned actuator assembly in FIG. 13A.

FIG. 14A is a horizontal cross-section view of the components of the gripping assembly 12 corresponding to the positions of the components of the rotary vaned actuator assembly 20 shown in FIG. 13A. The central cam body 77 is positioned to deploy the gripping jaws 80 upon rotation of the tong housing 36 relative to the central cam body 77. Central cam body 77 comprises three generally equi-angularly distributed troughs 77*a*, 77*b* and 77*c* as defined between three generally equi-angularly distributed lobes 77A, 77B and 77C. The three gripping jaws 80 shown in FIG. 14A are slidably received within three windows, 33A, 33B and 33C, and the gripping jaws 80 received in windows 33A, 33B and 33C slidably engage the central cam body 77 at troughs 77*a*, 77*b* and 77*c*, respectively.

Rotation of the tong housing 36, and the gripping jaws 80 slidably captured therein, relative to the central cam body 77 in either the direction of arrow 52 or in the direction of arrow 53 will result in the radially outwardly deployment of the gripping jaws 80 through the windows 33A, 33B and 33C of the tong housing 36. The following description of the modes of deployment of the gripping assembly 12 will explain the operation of the internally gripping power tong 10 of the present invention.

Figure 14B:
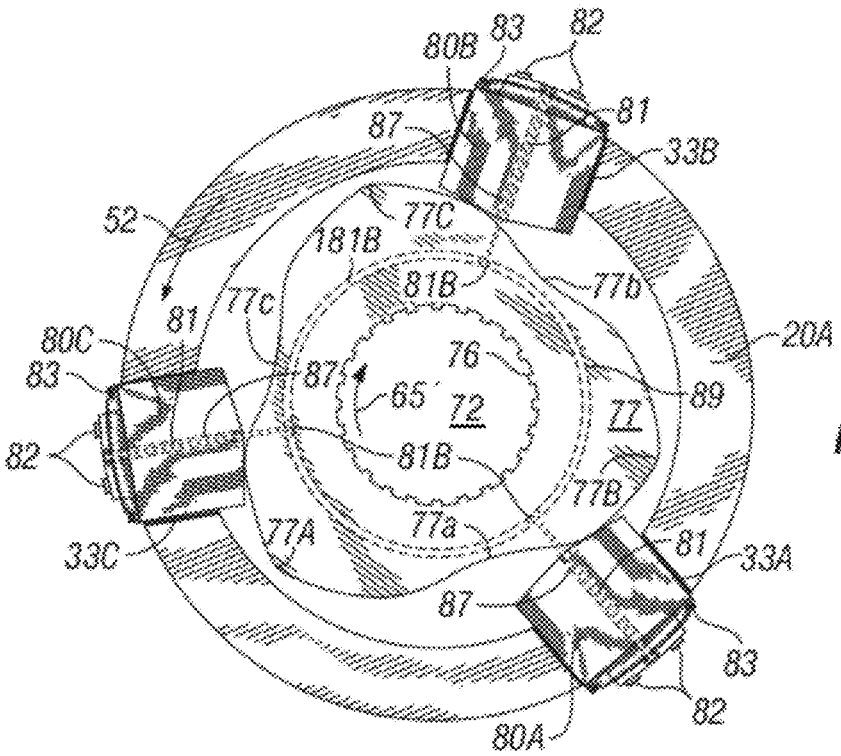
FIG. 14B is a horizontal cross-section view of the internally gripping tong of FIG. 3 revealing the tubular tong housing rotated counterclockwise from its position shown in FIG. 14A to deploy the gripping jaws to the make-up position. This view corresponds to the position of the rotary vaned actuator assembly in FIG. 13B.

FIG. 13B is a horizontal cross-section view of the rotary vaned actuator assembly 20 of FIG. 13A after the actuator housing 20A is rotated in the counterclockwise direction of arrow 52 relative to the rotary vaned assembly 43 to deploy the gripping assembly 12 to the "make-up" position. Pressurization of chambers 45B and 45D resulted in a net force across peripheral pistons 147 and 47 in the directions indicated by arrows 146 and 46, respectively (see FIG. 13A). FIG. 13B indicates the position of the actuator housing 20A after counterclockwise rotation of the actuator housing 20A resulting from the differential net forces 146 and 46 applied by hydraulic pressure to one shoulder only of the peripheral pistons 147 and 47, respectively. The make-up position is characterized as the position of the central cam body 77 as it is shown in corresponding FIG. 14B. Once the gripping jaws 80 are radially outwardly deployed in an amount sufficient to cause the gripping dies 82 to engage and grip the interior wall of the tubular segment (not shown in FIGS. 14A-14C) in which the internally gripping power tong 10 is inserted, resistance of the tubular segment to rotation by the shaft 65 in the direction 65' causes the gripping jaws 80 to be further cammed into gripping engagement with the interior wall of the tubular segment. As shown in FIG. 14B, resistance to the rotation of the internally gripping power tong 10 by the top drive assembly (not shown in FIG. 14B) through shaft 65 causes a gripping jaw 80A to be cammed further up on the cam surface from trough 77*a* onto lobe 77B, thereby tightening the grip of the internally gripping power tong 10 on the tubular segment. Similary, gripping jaw 80B will be cammed further up on the cam surface from trough 77*b* onto lobe 77C, and gripping jaw 80C will be cammed further up on the cam surface from trough 77*c* onto lobe 77A. This self-energizing feature enables the internally gripping power tong 10 of the present invention to minimize the torque application required from the rotary vaned actuator assembly 20 to that necessary to simply engage the gripping jaws 80 of the gripping assembly 12 with the interior wall of the tubular segment in which the internally gripping power tong 10 is disposed. Similarly, and as will be described below, the internally gripping tong 10 of the present invention is also self-energizing in the reverse, or break-out, direction.

Figure 14C:
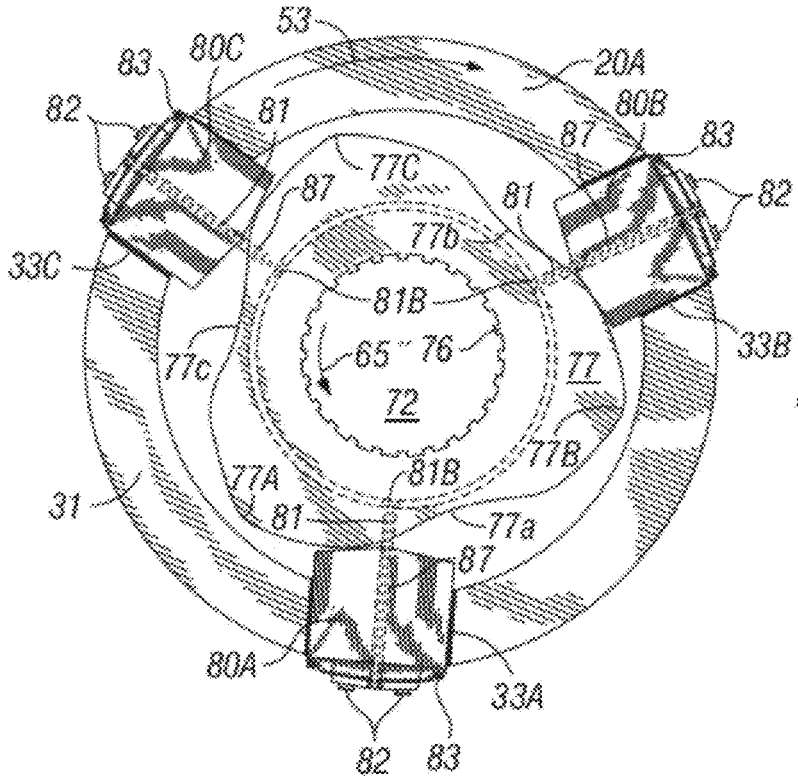
FIG. 14C is a horizontal cross-section view of the power tong of FIG. 3 revealing the tubular tong housing rotated clockwise from its position shown in FIG. 14A to deploy the gripping jaws to the break-out position. This view corresponds to the position of the rotary vaned actuator assembly in FIG. 13C.

FIG. 13C is the horizontal cross-section view of the rotary vaned actuator assembly 20 of FIG. 13A after the actuator housing 20 is rotated in the counterclockwise direction of arrow 53 relative to the vaned assembly 43 to deploy the gripping assembly 12 to the break-out position. The break-out position is characterized as the position shown in FIG. 14C because, once the gripping jaws 80 are deployed in an amount sufficient to engage and grip the interior bore of the tubular segment in which the internally gripping power tong 10 is inserted, resistance of the tubular segment to rotation by the shaft 65 in the direction 65" causes the gripping jaws 80 to be further cammed into gripping engagement with the interior bore of the tubular segment. As shown in FIG. 14C, once the rotary vaned actuator assembly 20 is operated to rotate the actuator housing 20A relative to the central cam body 77 and to thereby achieve the position shown in FIG. 14C, resistance to the rotation of the internally gripping power tong 10 imposed by top drive assembly through the shaft 65 causes gripping jaw 80A to be cammed further up from trough 77*a* onto lobe 77A, thereby tightening the grip of the internally gripping power tong 10 on the tubular segment. Similarly, gripping jaw 80B will be cammed further up from trough 77*b* onto lobe 77B, and gripping jaw 80C will be cammed further up from trough 77*c* onto lobe 77C.

Figure 15:
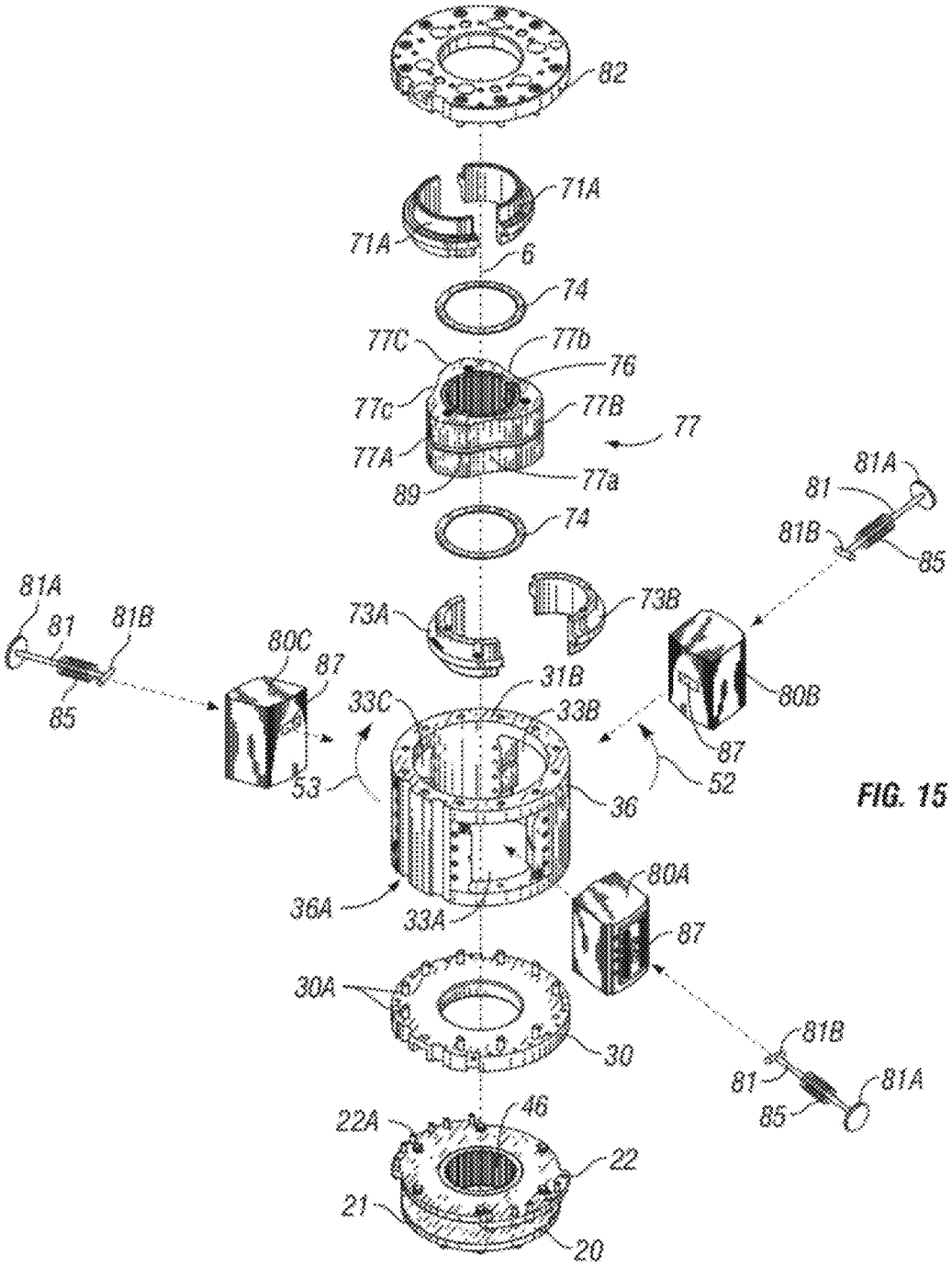
FIG. 15 is an axially exploded elevation view of the embodiment of the internally gripping power tong of FIG. 3.

FIG. 15 is an exploded perspective view of the gripping assembly 12 of the embodiment of the internally gripping tong 10 shown in FIGS. 3-12. The rotary vaned actuator assembly 20 is not shown in exploded form. FIG. 15 shows how the gripping jaws 80A-80C are secured against being inadvertently ejected from the windows 33A-33C of the tong housing 36. The T-stems 81 are generally elongate stems having a retainer plate 81A at an outer end and a T-shaped member 81B at an inner end, with a coil spring 85 disposed there between. Each of the gripping jaws 80A-80C comprise an aperture 87 for receiving the T-stem 81 there through. The central cam body 77 comprises a T-shaped channel (not shown in FIG. 15) for receiving and securing the T-shaped members 81B of the T-stems 81 there within by inserting the T-shaped member into the groove 89 on the central cam body 77 and then turning the T-stem 81 by turning the retainer plate 81A ninety degrees to align the T-shaped member 81B generally perpendicular to the radial direction of the groove 89.

Figure 16:
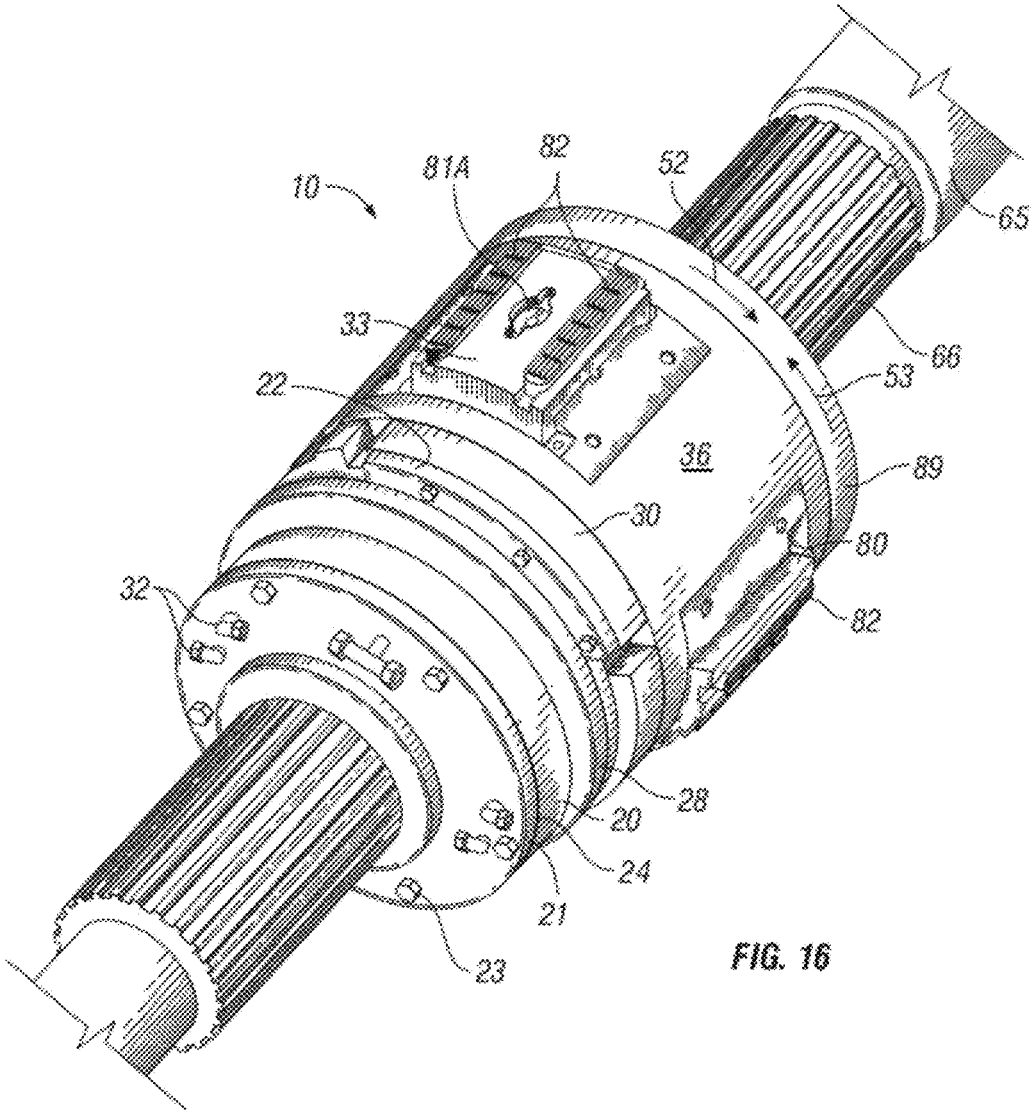
FIG. 16 is an inferior perspective view of the embodiment of the internally gripping power tong of FIG. 11.

FIG. 16 is an inferior perspective view of the embodiment of the internally gripping power tong of FIGS. 3-12 showing the direction of rotation arrow 52 for the tong housing 36 relative to the central cam body 77 to deploy the gripping jaws 80 to the make-up position, and the direction of rotation arrow 53 for the tong housing 36 relative to the central cam body 77 to deploy the gripping jaws 80 to the break-out position. As described above, the gripping jaws 80A-80C that are slidably received within the windows 33A, 33B and 33C of the tong housing 36 are cammed radially outwardly by rotation of the tong housing 36, relative to the central cam body 77, in either the direction of arrow 52 or the direction of arrow 53.

Figure 17:
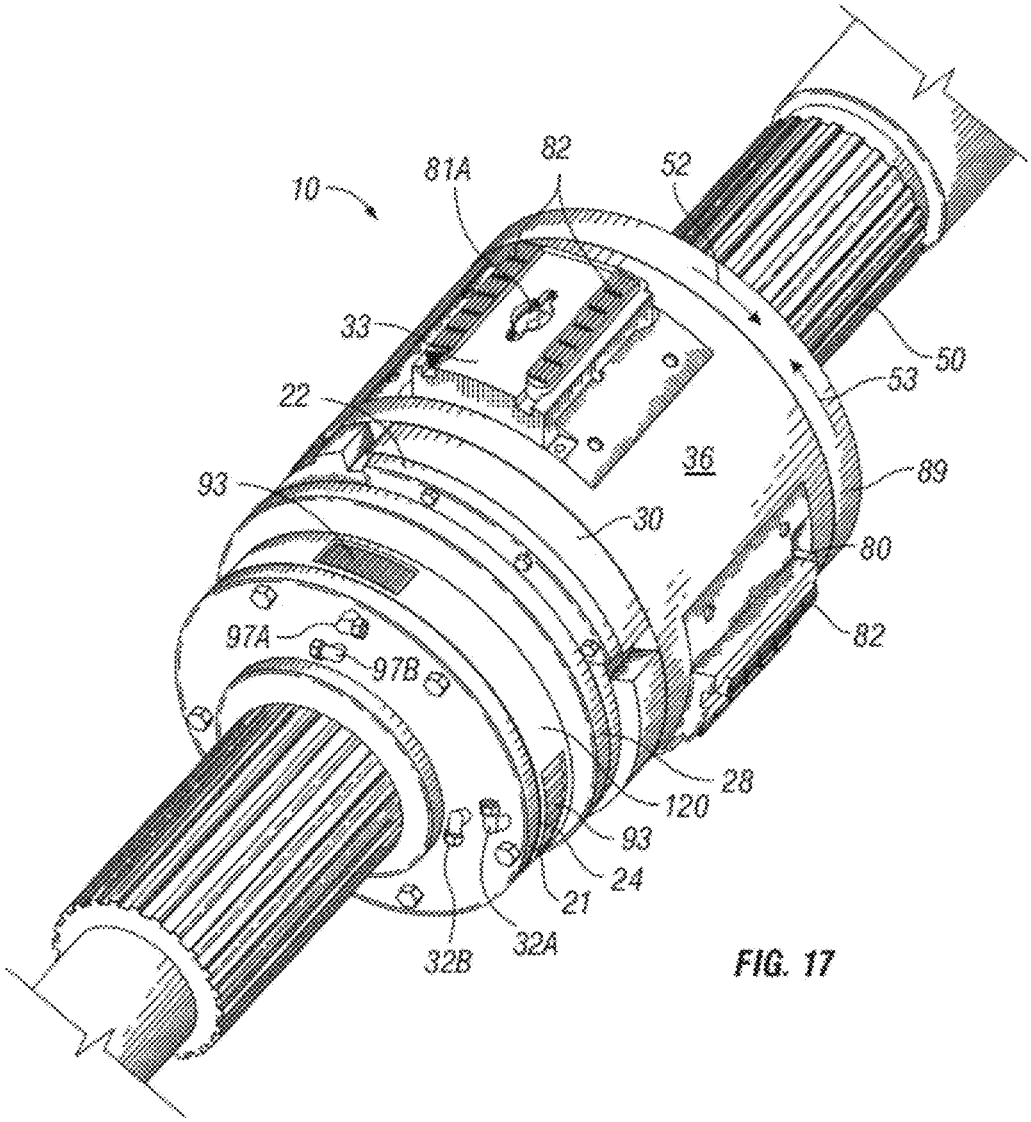
FIG. 17 is a perspective view of an alternate embodiment of the internally gripping power tong of the present invention having a deployable outrigger assembly coupled to the tubular tong housing of the internally gripping power tong of the present invention for frictionally engaging the interior wall of a tubular segment.

FIG. 17 is a perspective view of an alternate embodiment of the internally gripping power tong of the present invention having a deployable outrigger assembly 120 coupled to the tong housing 36 of the internally gripping power tong 10 of the present invention for frictionally engaging the interior wall of a tubular segment (not shown in FIG. 17). The outrigger assembly 120 illustrated in FIG. 17 comprises a plurality of radially outwardly deployable outriggers 93 coupled to hydraulic or pneumatic cylinders (not shown) that are operable to deploy and retract the outriggers by application of pressure to the cylinders through fluid couplings 97A and 97B.

Figure 18A:
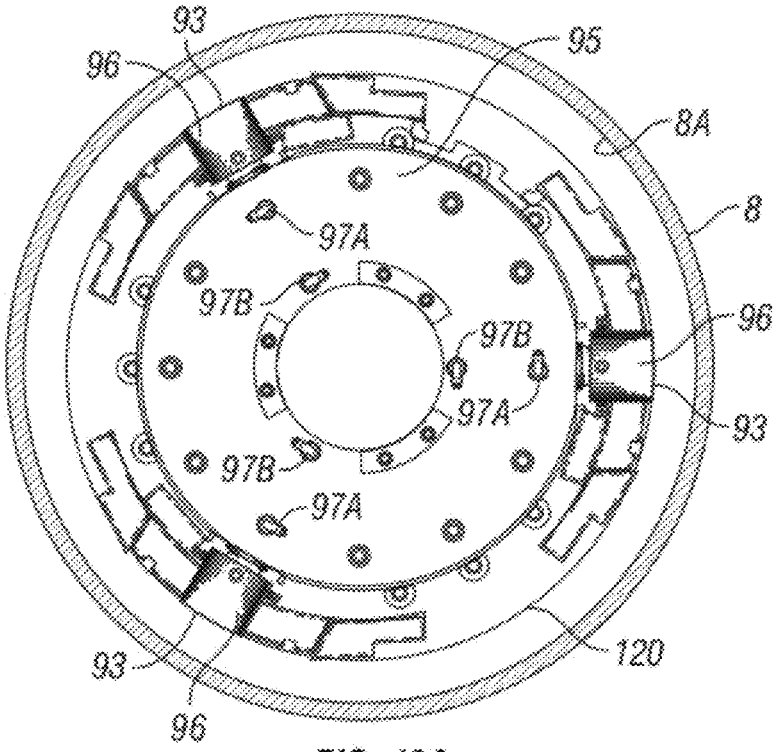
FIG. 18A is a horizontal cross-section view revealing the outrigger assembly shown in FIG. 17 in the retracted position within a tubular segment and deployable to cooperate with the top drive assembly to actuate the internally gripping power tong of the present invention.
Figure 18B:
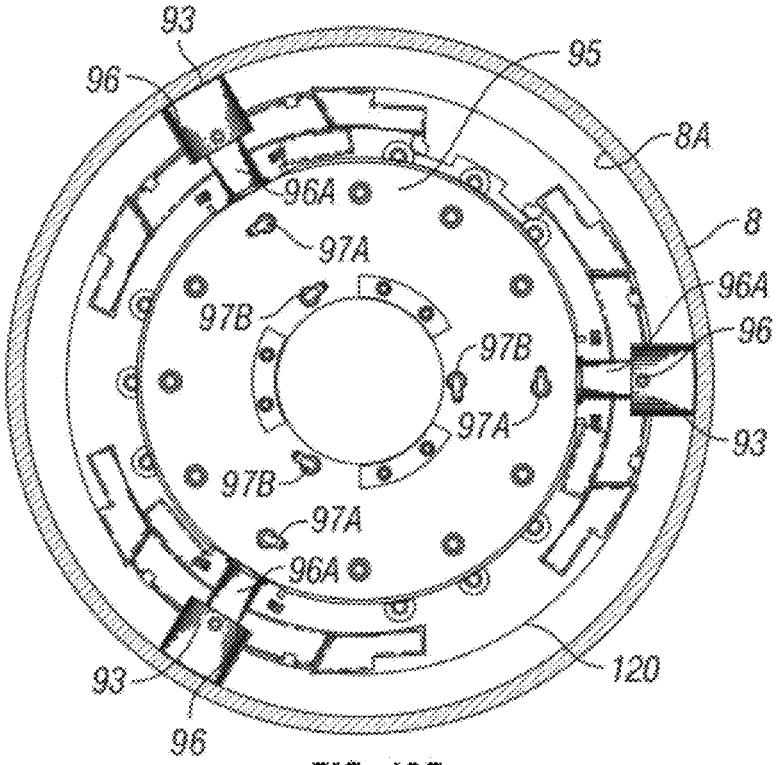
FIG. 18B is the cross-section view of FIG. 18A after the outriggers of the outrigger assembly are deployed radially outwardly to engage and grip the interior wall of the tubular segment to prevent or resist rotation of the outrigger assembly and the tubular tong housing within the bore of the tubular segment.

FIG. 18A is a horizontal cross-section view revealing the outrigger assembly 120 of FIG. 17 in the retracted position and positioned within the bore of a tubular segment 8 and deployable to cooperate with the top drive assembly (not shown) to actuate the internally gripping power tong of the present invention. The outriggers 96 are positioned adjacent to or within windows 93 within the outrigger housing 92 and coupled to cylinders operable through fluid fittings 97A and 97B. For example, placing fluid fittings 97B in communication with the discharge of a hydraulic fluid pump (not shown), and then placing fluid fittings 97A in communication with a fluid reservoir for receiving fluid and providing fluid to the suction of the hydraulic fluid pump, will operate the hydraulic cylinders coupled to the fluid fittings 97A and 97B to deploy the outriggers 96 radially outwardly through the windows 93 to engage and grip the interior wall 8A of the tubular segment 8 as shown in FIG. 18B. The interior bore of the outrigger assembly 120 does not have splines to rotatably couple the outrigger assembly 120 to the shaft 65. This allows relative rotation of the shaft 65 and the central cam body 77 (not shown in FIG. 18A or 18B) relative to the tong housing 36 and the outrigger assembly 120 coupled to the tong housing 36.

FIG. 18B is the cross-section view of FIG. 18A after the outriggers 96 are deployed radially outwardly by cylinder rods 96A to engage and grip the interior wall 8A of the tubular segment 8 to prevent or resist rotation of the outrigger assembly 120 and the tong housing that is coupled to the outrigger assembly (not shown in FIGS. 19A-19B) within the bore of the tubular segment 8 upon rotation of the shaft 65 (not shown in FIG. 19B-*see* FIGS. 3-10) by the quill 24A of the top drive assembly 24.

Figure 19A:
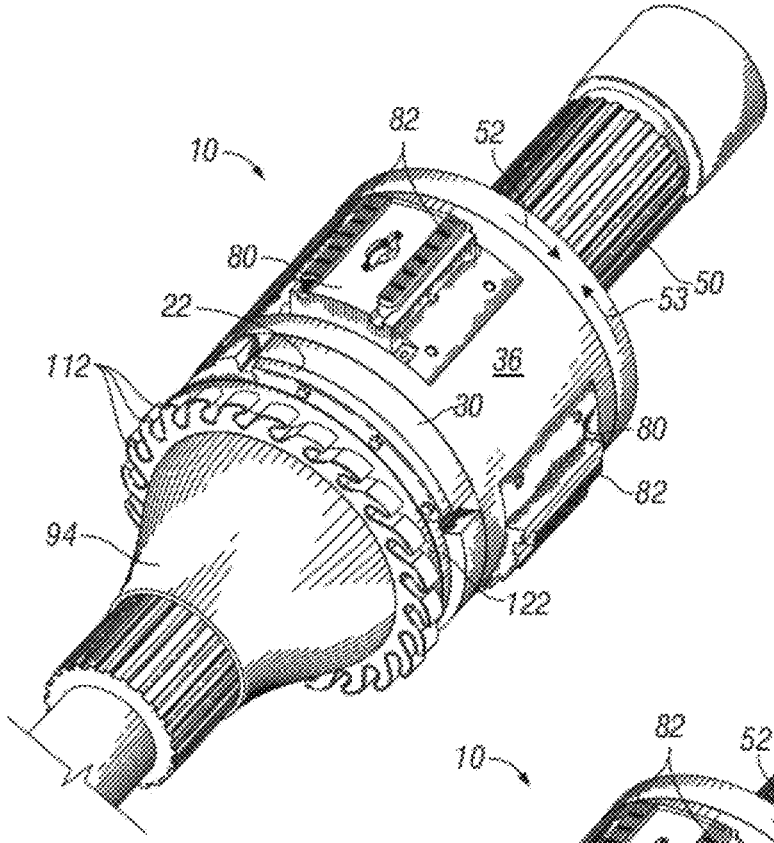
FIG. 19A is a perspective view of an alternative embodiment of the internally gripping power tong of the present invention having an arrangement of elastomeric sprags for preventing or resisting rotation of the tubular tong housing in a first direction within the bore of a tubular segment. The sprags are shown coupled to the exterior surface of the tubular tong housing and protruding radially outwardly to frictionally engage the interior wall of a tubular segment upon insertion of the internally gripping power tong into the bore of a tubular segment.
Figure 19B:
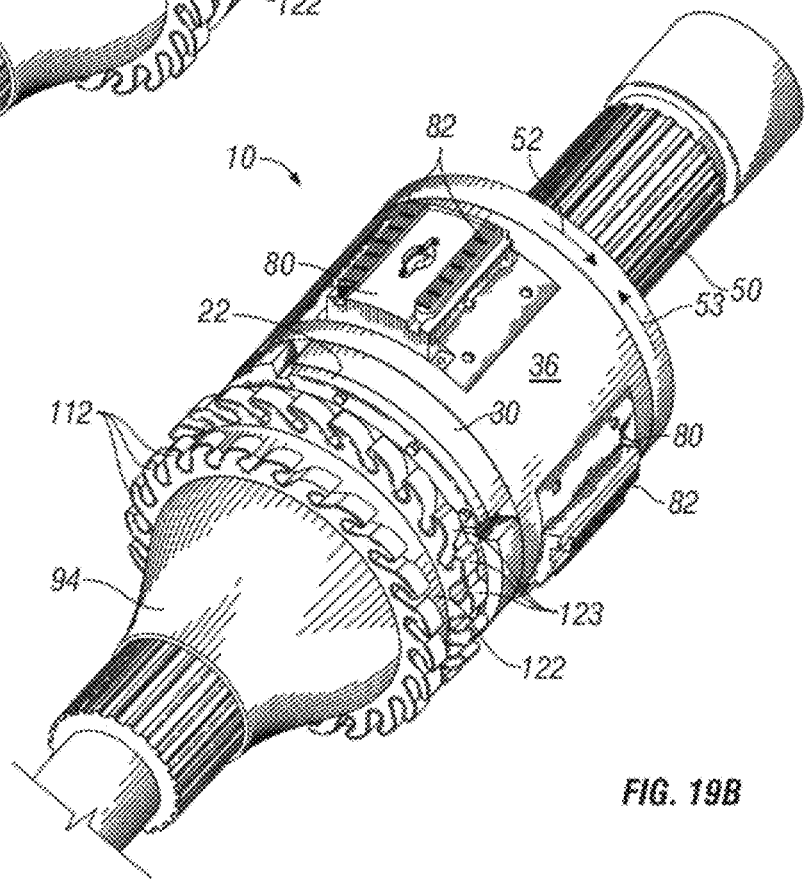
FIG. 19B is a perspective view of the alternative embodiment of FIG. 19A with a second and oppositely oriented arrangement of sprags for preventing or resisting rotation of the internally gripping power tong in either direction within the bore of a tubular segment.

FIG. 19A is a perspective view of an alternative embodiment of the internally gripping power tong 10 of the present invention having an arrangement of elastomeric sprags 112 supported on a sprag support 122 for preventing or resisting rotation, in a first direction, of the tong housing 36 within the bore of a tubular segment (not shown in FIG. 19A or 19B). The sprags 112 are shown coupled to the exterior surface of the sprag support 122 which is coupled to or integral with the tong housing 36. The sprags 112 protrude radially outwardly to engage the interior wall of a tubular segment (not shown in FIG. 19A-19B) upon insertion of the internally gripping power tong into the bore of a tubular segment. The sprags 112 may be shaped for permitting rotation of the sprag support 122 and the tong housing 36 in a first direction within the bore of the tubular segment, but resisting rotation of the sprag support and the tong housing in the second, opposite direction. For example, in FIG. 19A, the sprags are shaped for resisting rotation of the sprag support 122 and the tong housing 36 within the bore of a tubular segment (not shown) in the direction of arrow 52, but for permitting rotation of the sprag support 122 and the tong housing 36 within the bore of a tubular segment in the direction of arrow 53.

FIG. 19B is a perspective view of the alternative embodiment of the internally gripping tong shown in FIG. 19A with a second and oppositely oriented arrangement of sprags 123 for cooperating with the sprags 112 to prevent or resist rotation of the of the sprag support 122 and the tong housing 36 within the bore of a tubular segment in the direction of arrow 52 or arrow 53. In this embodiment, the lower arrangement of sprags 112 are shaped for resisting rotation of the sprag support 122 and the tong housing 36 within the bore of a tubular segment (not shown) in the direction of arrow 52, and the upper arrangement of sprags 123 are shaped for resisting rotation of the sprag support 122 and the tong housing 36 within the bore of a tubular segment in the direction of arrow 53. As a result, the two adjacent arrangements of sprags 112 and 123 together provide resistance to rotation of the sprag support 122 and the tong housing 36 coupled thereto within the bore of a tubular segment that is engaged by the sprags. This resistance to rotation of the sprag support 122 and the tong housing 36 provides for deployment of the gripping jaws 80 by rotation of the splined shaft 65 by the top drive assembly (not shown in FIGS. 19A and 19B—see FIGS. 3-10) by providing a differential torque between the central cam body 77 (not shown in FIGS. 19A and 19B) and the tong housing 36 that slidably retains the gripping jaws 80.

The actuation of the internally gripping power tong 10 using the "contact-type" actuators illustrated in FIGS. 18-19B is achieved by rotation of the tong housing 36 relative to the central cam body 77. This actuation is achieved using torque applied by the quill 24A of the top drive assembly 24 to the shaft 65 working in combination with a sprag ring or an outrigger assembly that is rotatably locked to the tong housing 36 of the gripping assembly 12 to prevent rotation of the tong housing 36 relative to the interior bore of the tubular segment. By frictionally coupling the tubular segment to the tong housing 36, the sprags or the outrigger assembly imparts a large amount of rotational inertia to the tong housing 36 so that the onset of normal rotation of the shaft 65 by the quill 24A of the top drive assembly 24 in either direction will result in a large enough differential torque between the central cam body 77 and the tong housing 36 to deploy the gripping jaws 80A-80C to engage and grip the tubular segment.

The terms used herein to describe embodiments of the present invention, to disclose the present invention, and to claim the present invention should be given their broad meaning. For example, but not by way of limitation, the terms "comprising," "including," and "having," as used in the claims and specification herein, shall be considered as indicating an open group that may include other elements not specified. The term "consisting essentially of," as used in the claims and specification herein, shall be considered as indicating a partially open group that may include other elements not specified, so long as those other elements do not materially alter the basic and novel characteristics of the claimed invention.

The terms "a," "an," and the singular forms of words shall be taken to include the plural form of the same words, such that the terms mean that one or more of something is provided. For example, the phrase "a gripping jaw comprising two sides" should be read to describe a gripping jaw having two or more than two sides.

The terms "at least one" and "one or more" are used interchangeably. The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of the invention.

It should be understood from the foregoing description that various modifications and changes may be made in the preferred embodiments of the present invention without departing from its true spirit. The foregoing description is provided for the purpose of illustration only and should not be construed in a limiting sense. Only the language of the following claims should limit the scope of this invention.

We claim:

1. An internally gripping tong to grip a bore of a tubular segment, comprising:

a housing having a bore and a plurality of angularly distributed windows to movably receive a plurality of jaws between a retracted position and a deployed position;

an externally-splined shaft rotatably received within the bore of the housing; and a cam body having an internally-splined bore received on the externally-splined shaft central to the plurality of jaws, the cam body having a plurality of camming surfaces thereon;

wherein rotation of the housing relative to the cam body deploys the plurality of jaws from the retracted position radially outwardly within the plurality of windows to the deployed position to engage an interior wall of the tubular segment.

2. An apparatus for releasably gripping an interior wall of a tubular segment comprising:

a generally tubular housing having a bore and a plurality of angularly distributed windows;

a shaft having external splines for receiving and rotatably coupling the shaft to a cam body rotatably positioned within the bore of the housing generally central to the windows; and a plurality of deployable followers slidably disposed within the windows;

wherein rotation of the cam body deploys the followers radially outwardly within the windows to engage the tubular segment.

3. The apparatus of claim 2 further comprising a rotary vaned actuator assembly coupled to the cam body to rotate the cam body relative to the housing and thereby deploy the followers into engagement with the wall of the tubular segment.

4. The apparatus of claim 3 wherein the rotary vaned actuator assembly is hydraulically powered.

5. An apparatus for rotatably deploying a tubular gripping tool comprising:

a rotary vaned actuator assembly having a splined bore to slidably receive a splined shaft;

a cam body having a plurality of cam surfaces and a splined bore to slidably receive the splined shaft;

a housing having a bore for receiving the cam body and a plurality of generally angularly distributed windows; and a plurality of gripping jaws, movably received within the windows, having camming surfaces and gripping surfaces and positioned to engage the camming surfaces against cam surfaces on the cam body upon rotation of the cam body relative to the housing.

6. A method for making up and running a tubular string into an earthen borehole comprising:

supporting a tubular string suspending device generally aligned with the earthen borehole using a rig;

supporting a tubular string within the earthen borehole with the tubular string suspending device by engaging and supporting the proximal end of the tubular string at a location just below an uppermost, threaded end of the tubular string;

translatably and rotatably supporting a tool for internally gripping a tubular segment from a downwardly disposed quill of a top drive assembly that is generally aligned with the earthen borehole;

suspending an elevator from the top drive assembly at a position intermediate the tool and the tubular string suspending device generally aligned with the tool and the borehole;

supporting a tubular segment having a first end and a threaded, second end using the elevator coupled to the tubular segment at the first end;

supporting the threaded second end of the tubular segment with the uppermost and threaded end of the suspended tubular string;

aligning the first end of the tubular segment with the tool to receive the tool within the bore of the tubular segment;

lowering the top drive assembly to slide the elevator downwardly along a portion of a length of the tubular segment;

continuing to lower the top drive assembly to insert the tool into the bore of the tubular segment;

deploying the tool to grip an interior wall of the tubular segment;

rotating the tool using the quill of the top drive assembly to make-up a threaded connection between the uppermost, threaded end of the suspended tubular string and the threaded, second end of the tubular segment to a predetermined torque;

retracting the tool to release the tubular segment;

raising the top drive assembly to withdraw the tool from the bore of the tubular segment;

continuing to raise the top drive assembly to slide the elevator back up along the portion of the length of the tubular segment;

continuing to raise the top drive assembly to reengage the elevator to the first end of the tubular segment; and continue raising the top drive assembly to support the now-extended tubular string, including the tubular segment, using the top drive assembly.

7. An apparatus for gripping and rotating a tubular segment comprising:

a housing having a bore and plurality of generally angularly distributed windows to slidably receive gripping jaws having radially outwardly disposed gripping surfaces and radially inwardly disposed camming surfaces; and a rotatable central cam body having a plurality of cam surfaces thereon to engage the camming surfaces of the gripping jaws and displace the gripping jaws radially outwardly within the windows to bear against an interior wall of the tubular segment into which the apparatus is inserted;

wherein at least one gripping jaw comprises one or more slots there through forming a pathway between the gripping surface and the camming surface to receive a generally T-shaped retainer to secure the gripping jaw to the cam body having a generally T-shaped recess therein to receiving and movably couple the gripping jaw in sliding engagement with at least a portion of the cam body.

8. An apparatus to internally grip the bore of a tubular segment comprising:

a generally tubular housing having one or more windows to slidably receive one or more radially movable gripping jaws; and a cam body rotatably disposed within the bore of the housing adjacent the one or more windows to radially deploy the one or more gripping jaws upon rotation of the housing relative to the cam body;

wherein the one or more gripping jaws engage the cam body between a retracted position and one of a first deployed condition and a second deployed condition, wherein the first deployed position is obtained by rotation of the housing in a first direction relative to the cam body and the second deployed position is obtained by rotation of the housing in the opposite direction relative to the cam body.

9. The apparatus of claim 8 further comprising an actuator to rotate the housing relative to the cam body.

10. The apparatus of claim 9 wherein the cam body is slidably received on a shaft.

11. The apparatus of claim 10 wherein an exterior of the shaft is axially splined and the cam body has an internally splined bore to rotatably couple the cam body on the shaft and permit sliding movement along at least a portion of the shaft.

12. The apparatus of claim 11 wherein the shaft further comprises a bore to facilitate fluid flow through the apparatus.

13. The apparatus of claim 9 wherein the actuator comprises one or more elastomeric members disposed on an exterior of the housing to engage the interior wall of the tubular segment and frictionally resist rotation of the housing within the bore of the tubular segment upon rotation of the shaft.

14. The apparatus of claim 13 wherein the actuator further comprises a rotary vaned actuator assembly that comprises at least one angularly expandable chamber.

15. The apparatus of claim 14 wherein the rotary vaned actuator assembly further comprises an angularly expandable chamber and an adjacent angularly retractable chamber, wherein the angularly expandable chamber receives fluid from a pump and expands as the adjacent angularly retractable chamber displaces fluid to a reservoir as it retracts.

16. The apparatus of claim 8 further comprising a deployable outrigger device to engage and frictionally couple the housing of the apparatus to an interior wall of the tubular segment, and a threaded connection for coupling the cam body to a quill of a top drive;

wherein deployment of the outrigger device and rotation of the quill of the top drive assembly causes rotation of the housing relative to the cam body to deploy the gripping jaws.

17. The apparatus of claim 8 comprising at least one elastomeric member secured to an exterior of the housing for frictionally engaging an interior wall of the tubular segment; wherein rotation of a quill of the top drive assembly causes rotation of the housing relative to the cam body to deploy the gripping jaws.

18. An apparatus to internally grip the bore of a tubular segment comprising:

a generally tubular housing having one or more windows to slidably receive one or more radially movable gripping jaws;

a cam body rotatably disposed within the bore of the housing adjacent the one or more windows to radially deploy the one or more gripping jaws upon rotation of the housing relative to the cam body; and a deployable outrigger device to engage and frictionally couple the housing of the apparatus to an interior wall of the tubular segment, and a threaded connection for coupling the cam body to a quill of a top drive, wherein deployment of the outrigger device and rotation of the quill of the top drive assembly causes rotation of the housing relative to the cam body to deploy the gripping jaws.

19. An apparatus to internally grip the bore of a tubular segment comprising:

a generally tubular housing having one or more windows to slidably receive one or more radially movable gripping jaws;

a cam body rotatably disposed within the bore of the housing adjacent the one or more windows to radially deploy the one or more gripping jaws upon rotation of the housing relative to the cam body; and at least one elastomeric member secured to and exterior of the housing for frictionally engaging and interior wall of the tubular segment; wherein rotation of a quill of the top drive assembly causes rotation of the housing relative to the cam body to deploy the gripping jaws.

* * * * *